US007842162B1

(12) United States Patent
Lvov et al.

(10) Patent No.: US 7,842,162 B1
(45) Date of Patent: Nov. 30, 2010

(54) LAYER-BY-LAYER NANOCOATING FOR PAPER FABRICATION

(75) Inventors: Yuri M. Lvov, Ruston, LA (US); George Grozdits, Ruston, LA (US)

(73) Assignee: Louisiana Tech University Foundation, Inc., Ruston, LA (US)

( * ) Notice: Subject to any disclaimer, the term of this patent is extended or adjusted under 35 U.S.C. 154(b) by 1206 days.

(21) Appl. No.: 11/372,945

(22) Filed: Mar. 11, 2006

Related U.S. Application Data

(60) Provisional application No. 60/661,640, filed on Mar. 14, 2005, provisional application No. 60/756,671, filed on Jan. 6, 2006.

(51) Int. Cl.
*D21F 11/00* (2006.01)

(52) U.S. Cl. ..... 162/158; 162/164.1; 162/164.6; 162/166; 162/168.3; 162/174; 162/181.1; 162/181.4; 162/181.8; 162/182

(58) Field of Classification Search ..... None
See application file for complete search history.

(56) References Cited

PUBLICATIONS

Malin Eriksson, Shannon M. Notley, Lars Wagberg, The influence on paper strength properties when building multilayers of weak polyelectrolytes onto wood fibres, Journal of Colloid and Interface Science, 292(1) Dec. 1, 2005, pp. 38-45, (http://www.sciencedirect.com/science/article/B6WHR-4GHRC3D-3/2/fc8c53c5390d3ed026ec16a30d0a0ade).*

* cited by examiner

*Primary Examiner*—Philip C Tucker
*Assistant Examiner*—Michael J Felton
(74) *Attorney, Agent, or Firm*—Jones Walker Waechter Poitevent Carrere & Denegre, LLP

(57) ABSTRACT

A method is provided for manufacturing paper by means of layer-by-layer nanocoating techniques. The method comprises the sequential processing of an aqueous pulp of lignocellulose fibers which is first subjected to nanocoating by alternatively adsorbing onto the fibers multiple consecutively-applied layers of oppositely-charged nanoparticles, polymers and/or proteins thereby making a modified aqueous pulp of multi-layer nanocoated lignocellulose fibers, then draining the water out of the modified pulp to form sheets of multi-layer nanocoated fibers, and drying the formed sheets of multi-layer nanocoated fibers. The resulting dried sheets are then processed to make a finished paper that has superior physical strength and improved surface properties. In a preferred embodiment the starting aqueous pulp of lignocellulose fibers is divided into is separate portions which are separately nanocoated with opposite charges, and then blended to form a complex aggregate pulp of nanocoated fibers before draining and drying it. The method is particularly applicable to the treatment of broken (mill broke) recycled fibers in order to facilitate their usage in paper production.

33 Claims, 22 Drawing Sheets

Scheme of the layer-by-layer assembly by alternate adsorption of polycations and polyanions or nanoparticles.

Scheme of the layer-by-layer assembly by alternate adsorption of polycations and polyanions or nanoparticles.

Formula of basic component of cellulose fiber

LAYER-BY-LAYER NANOCOATING FOR PAPER FABRICATION

This application is a non-provisional application for patent entitled to a filing date and claiming the benefit of earlier-filed Provisional Applications for Patent No. 60/661,640, filed on Mar. 14, 2005, and No. 60/756,671, filed on to Jan. 6, 2006 under 37 CFR 1.53 (c).

FIELD OF THE INVENTION

This invention relates to the manufacture of paper. In particular, this invention relates to a method for improving the manufacture of paper by means is of nanocoating techniques. Specifically, the invention relates to a method and a process for making paper of enhanced strength and surface properties by means of layer-by-layer nanocoating techniques.

BACKGROUND OF THE INVENTION

Traditional paper manufacture begins with the processing of its primary raw material, which is cellulose fiber. Most woods are made up of roughly 50% cellulose, 30% lignin and 20% of mixtures of aromatic hydrocarbons and hemicellulose carbohydrates. In order to obtain cellulose in usable form for paper manufacture the wood is normally pulped to separate the fibers and remove the impurities. The higher the cellulose content of the resulting pulp and the longer the fibers, the better the quality of the paper. Hardwoods generally contain a higher proportion of cellulose but of shorter fiber length than softwoods, which are more resinous. Lignin acts as the resinous adhesive that holds the fibers together. Cotton, linen, straw, bamboo, certain grasses and hemp are also sometimes used as a source of fiber for papermaking. The pulp used in papermaking is the result of the mechanical or chemical breakdown of fibrous cellulose materials into fibers which, when mixed with water, can be spread as thin layers of matted strands. When the water is removed the layer of fibers remaining is essentially paper. Various materials and chemicals are often added to give the paper a better surface for printing, greater density or extra strength. These materials and chemicals are not always cost effective or environmentally friendly.

In addition to cost and environmental considerations, improvements in paper design, production and quality are currently the paper manufacture industry's highest priorities. Pulping, process chemistry, paper coating and recycling are key areas that can benefit from the nanotechnology field, such as polyelectrolyte layer-by-layer (L-b-L) self-assembly. An environmentally friendly process offered by L-b-L nanoassembly may provide important development to the industry.

In the last decade electrostatic layer-by-layer (L-b-L) self-assembly techniques have been developed as a practical and versatile way of creating thin polymeric films both on large surfaces and on microcores. These techniques allow the design of ultra thin coatings with a precision better than one nanometer, and with defined molecular composition. The method of this invention incorporates the use of these layer-by-layer self-assembly techniques as a step in a plurality of sequential unit operations designed to manufacture paper of improved strength and enhanced surface properties. It is an object of this invention to provide a method for the manufacture of paper of improved strength and enhanced surface properties. It is also an object of this invention to provide a cost-effective process for fabricating paper using nanotechnology layer-by layer self-assembly techniques. Another object of this invention is to provide an application of nanotechnology layer-by-layer self-assembly techniques to paper manufacture that is particularly suitable to the treatment of wood fibers and lignocellulose pulps containing broken (mill broke) recycled fibers so as to allow the cost-effective use of such pulps in the manufacture of paper with enhanced strength and surface properties. These and other objects of the invention will become apparent from the reading of the description that follows.

BRIEF DESCRIPTION OF THE INVENTION

The above objects may be achieved by the method of this invention which is based on an application of new nanotechnology techniques to the processing of paper pulps, specifically the use of a new layer-by-layer nanoassembly method for coating pulp and paper fibers in order to improve the performance of the final products. Layer-by-layer nanoassembly techniques employ aqueous polymer solutions, may be easily scaled up to mass production and are environmentally friendly.

The method of this invention comprises forming a pulp of lignocellulose fibers and nanocoating it by alternatively adsorbing onto the fibers multiple consecutively-applied organized ultra thin layers of oppositely-charged nanoparticles and polymers thereby making a modified aqueous pulp of multi-layer nanocoated lignocellulose fibers, then draining the water out of the modified pulp to form sheets of multi-layer nanocoated fibers, and drying the formed sheets of multi-layer nanocoated fibers. The resulting dried sheets are then processed to make a finished paper that has superior physical strength and improved surface properties.

In a preferred embodiment of the invention the starting aqueous pulp of lignocellulose fibers is divided into separate portions which are separately nanocoated by alternatively adsorbing onto the fibers multiple consecutively-applied layers of oppositely-charged nanoparticles and polymers so as to impart a positive charge to one portion and a negative charge to the other portion, then blending the two portions to form a complex aggregate pulp of nanocoated fibers. The thus modified complex aggregate pulp is subsequently drained and dried to form sheets of multi-layer nanocoated fibers, and then processed to make a paper with enhanced strength and surface properties. One embodiment of the invention involves also the additional use of oppositely-charged proteins under controlled conditions to nanocoat the fibers.

BRIEF DESCRIPTION OF THE DRAWINGS

A clear understanding of the key features of the invention summarized above may be had by reference to the appended drawings, which illustrate the method of the invention, although it will be understood that such drawings often depict preferred embodiments of the invention and, therefore, are not to be construed as limiting its scope with regard to other embodiments which the invention intends and is capable of contemplating. Accordingly, FIG. 1(*a*) is a scheme of a layer-by-layer assembly by alternate adsorption of linear or branched polycations and polyanions or nanoparticles;

FIG. 1(*c*) is a scanning electron microscopy cross-sectional image of 28-nm-thick [poly(ethyleneimine)/(montmorillonite clay) multilayer on a silicon surface.

FIG. 5 (*b*) is a laser confocal image of alternate adsorption treated IP Augusta Hardwood pulp fibers.

FIG. 13 is a graphic illustration of results obtained in determining the tensile strength (in Newtons. Meters/gram) of various paper hand sheets made from different mixtures of original fibers with negatively and positively charged layer-by-layer coated fibers.

DETAILED DESCRIPTION OF THE INVENTION

Figure 1A:
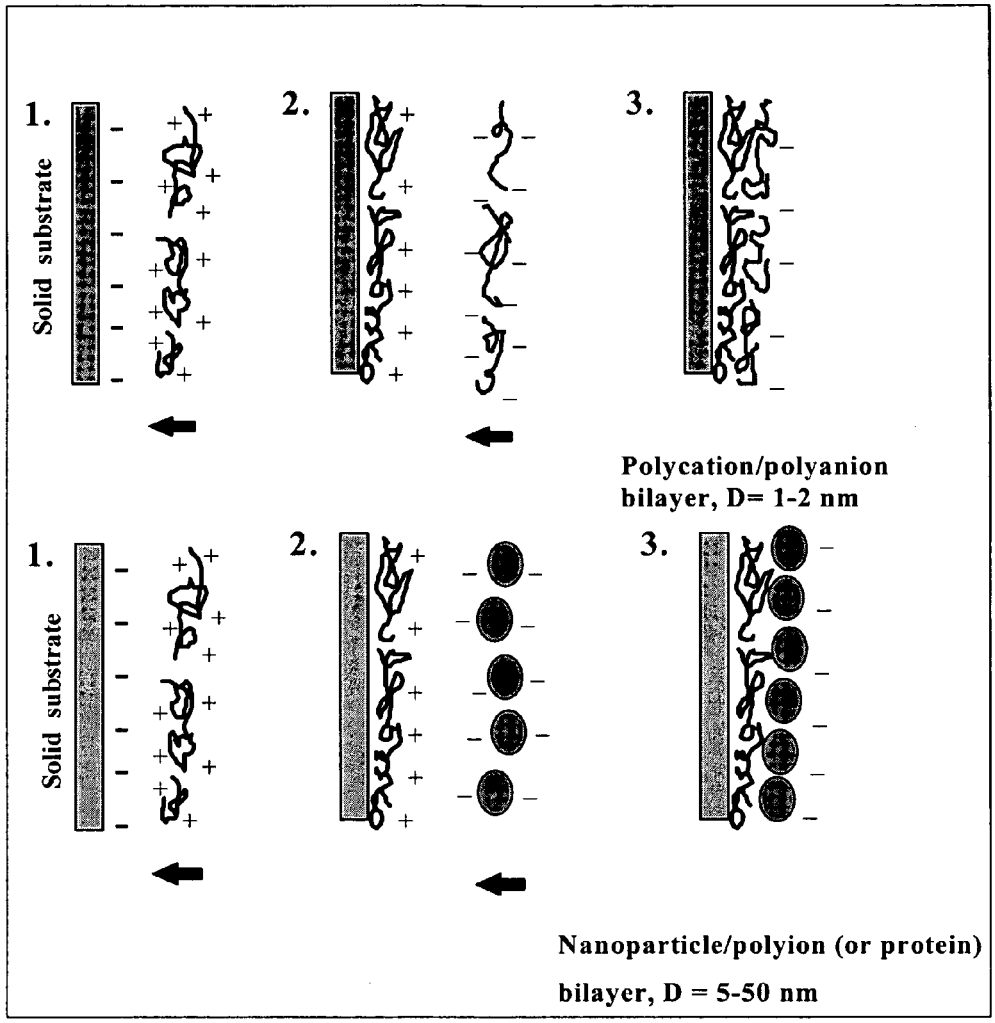
FIG. 1(*b*) is a scanning electron microscopy cross-sectional image of 220-nm-thick [glucose oxidase/poly(ethyleneimine)/coating on quartz.

The first step of the method of this invention involves forming a pulp of lignocellulose fibers. A slurry of between approximately 0.5 and 15% by weight solids is prepared by conventional paper manufacturing techniques using virgin lignocellulose fibers and/or broken (mill broke) recycled fibers. The slurry is preferably an aqueous slurry. In addition to virgin lignocellulose and/or broken recycled fibers the initial slurry may also contain various additives and other chemicals often used in the paper making industry and beneficial to the paper manufacture process. The slurry may also contain mixtures of synthetic fibers in various proportions. The second step comprises the nanocoating of the pulp by alternatively impregnating the pulp fibers with multiple consecutively-applied layers of oppositely-charged nanoparticles and polymers. Oppositely-charged nanoparticles are inorganic solid materials. They differ from polymers in that they preserve their shape and dimensions, and possess functionality due to their shape (like nanotubules). (See Encyclopedia of Nanoscience and Nanotechnology, v.7, Editor: H. Nalwa, American Scientific Publishers, 2004, Chapter 8: Nanoparticles as Delivery Systems; and Chapter 9: Nanoparticles for Live-Cell Dynamics.) Non-limiting examples of suitable oppositely-charged nanoparticles which may be used in the method of this invention include 10-100 nm silica, $Al_2O_3$, $TiO_2$, plate-like and tubule clays (kaolinates and hallosites) and other dispersible-in-water nanoparticles. The oppositely-charged nano-particles and polymers are made available in the form of a solution or dispersion containing the nanoparticles and the polymers. The treatment of the pulp with the solution in order to impregnate the pulp fibers with the solution and cause the nanoparticles and the polymers to be adsorbed onto the fibers is carried out by adding the solution to and mixing it with the pulp thereby causing the alternate adsorption of nanoparticles with oppositely charged polymers. The number of adsorbed nanoparticle layers is controlled by carrying out the operation so that the ratio of oppositely-charged nanoparticles and polymers to lignocellulose fibers contained in the aqueous pulp is between about 0.1 and 5% by dry weight of nanoparticles and polymers to dry weight of fibers. Other embodiments may employ higher or lower weight percents of nanoparticles and polymers. Protein nanocoating of fibers has also been developed similar to the nanoparticle coating. The bio-catalytic properties of protein nanocoating (e.g., nanocoating with enzymes such as laccase) may be used to improve paper whiteness through catalytic lignin decomposition. The resulting modified aqueous pulp of multi-layer nanocoated fibers is drained of water utilizing drain screens to form sheets of multi-layer nanocoated fibers. The resulting dried sheets are then processed to make a finished paper, or paper board, that has superior physical strength and improved surface properties.

In one preferred embodiment of the invention the starting aqueous pulp of fibers is first divided into two separate portions roughly equal in volume, alternatively impregnating them with the nanoparticle solutions, as already described, and causing the adsorption of the oppositely-charged nanoparticles and polymers on the fibers. The technique involves nanocoating one such portion with multiple consecutively-applied organized ultra thin layers of oppositely-charged nanoparticles and polymers so as to impart a positive charge to the outermost layer of the fiber substrate. The other portion is then separately treated in similar fashion but the treatment is carried out so as to impart a negative charge to the outermost layer of the fiber substrate. The two portions are then blended with each other during the paper making process. The thus modified complex aggregate pulp, which normally exhibits a substantially neutral charge, is subsequently drained and dried to form sheets of multi-layer nanocoated fibers in the manner described above, and then processed to make paper, or paper board, with enhanced strength and surface properties. Another preferred embodiment of the invention provides for nanocoating a first portion of pulp with oppositely-charged polymers under controlled conditions to impart the positive charge, and nanocoating a second portion of pulp with oppositely-charged nanoparticles to impart the negative charge. An application of this procedure to pulps of broken recycled fibers allows an increase in and facilitates the use of recycled fibers in paper making without loosing paper strength.

Figure 1B:
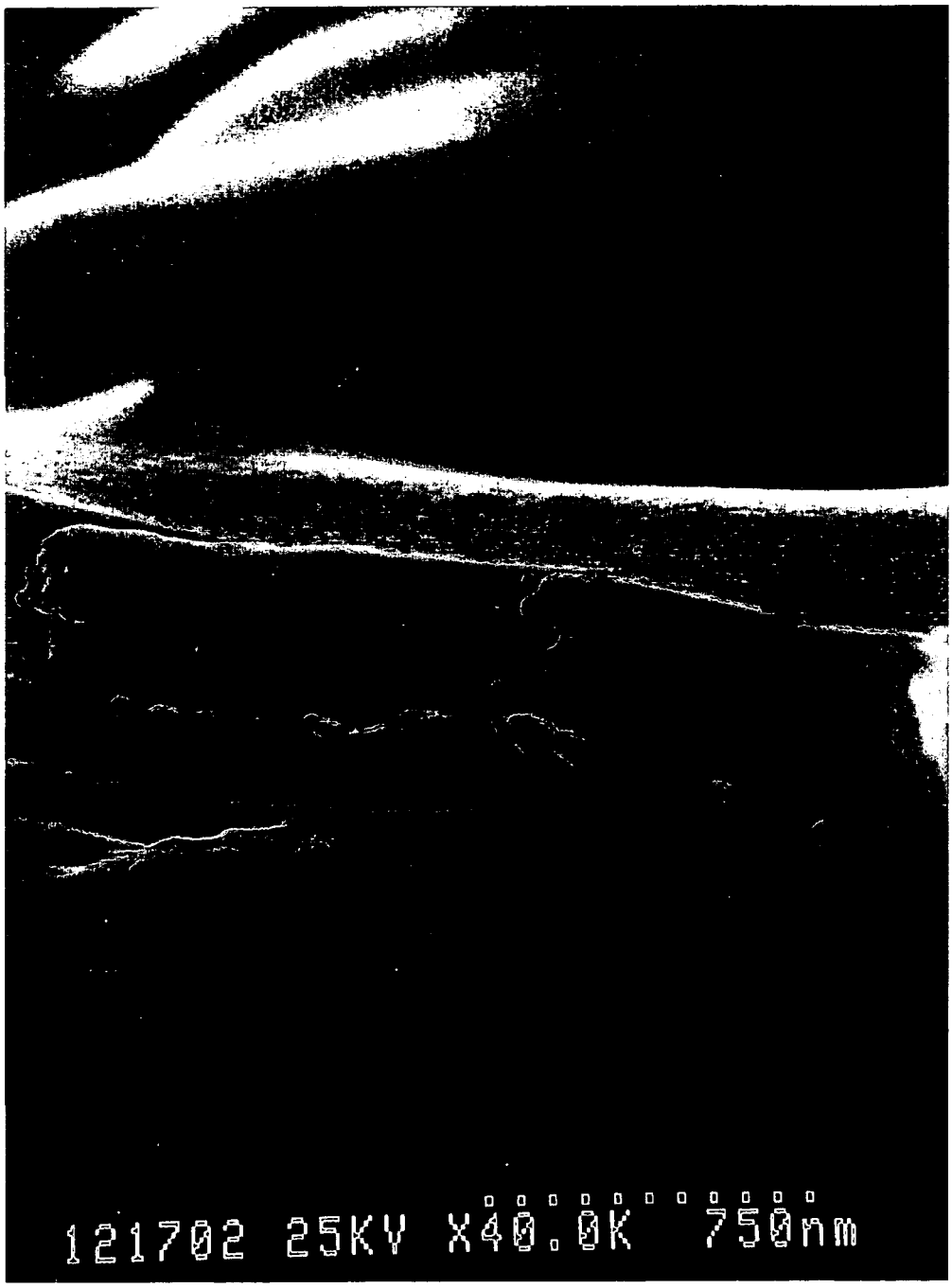
Figure 1C:
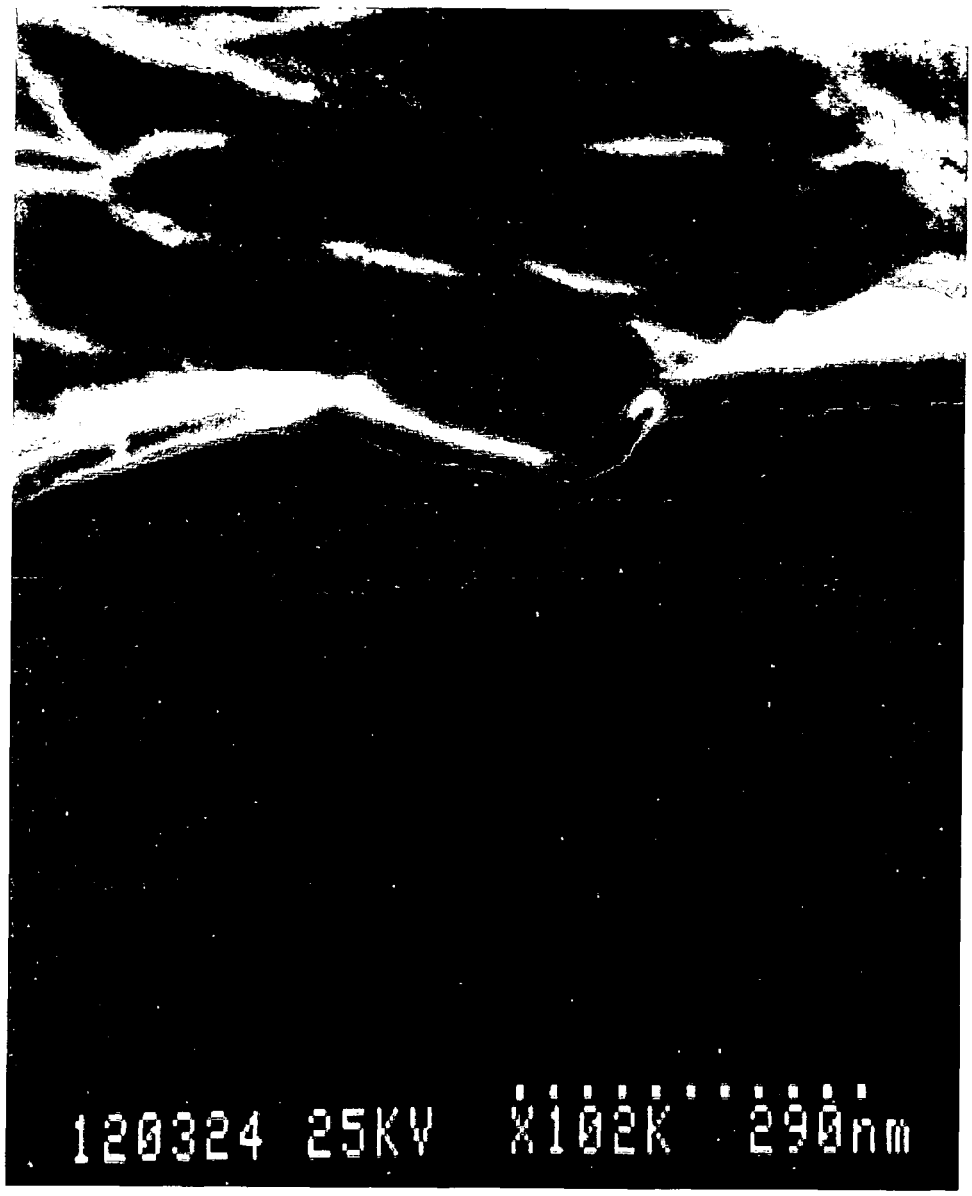

The technique for layer-by-layer (L-b-L) self-assembly of thin films by means of alternate adsorption of oppositely-charged linear polyions and nanoparticles involves re-saturation of polyion/nanoparticle adsorption, resulting in the reversal of the terminal surface charge of the film after deposition of each layer. The technique allows the design of ultra thin multilayer films with a precision better than one nanometer, with well defined molecular composition. FIG. 1(*a*) illustrates the scheme of the layer-by-layer assembly by alternate adsorption of linear or branched polycations and polyanions or nanoparticles. FIG. 1(*b*) shows a scanning electron microscopy ("SEM") cross-sectional image of 220 nm thick [glucose oxidase/poly(ethylenimine)] coating on quartz. FIG. 1(*c*) shows the SEM cross-sectional image of 28-nm thick [poly(ethylenimine)/(montmorillonite clay)] multilayer on a silicon surface.

The L-b-L self-assembly technique is applied by alternate adsorption of oppositely-charged components, such as linear or branched polyions, proteins, DNA and charged nanoparticles (including silica and clay), for systematic modification of pulp and paper. Pulp coating is based on the L-b-L nanoassembly on micro template technique (See F. Caruso, R. Caruso, H. Mohwald, Science, v. 282, 1111-1114, 1998, "Fabrication of hollow, spherical silica and composite shells via electrostatic self-assembly of nanocomposite multilayers on decomposable colloidal templates"; Y. Lvov, R. Price, A. Singh, J. Selinger and J. Schnur, Langmuir 16: 5932-5935, 2000 "Nanoscale patterning on biologically derived microstructures"; Y. Lvov, R. Price, Colloids and Surfaces: Biointerfaces, v.23, 273-279 2002 "Nanoparticle polyion assembly on micro templates (lipid tubules and latex spheres)"; R. Davidson "Theory of Strength Development," in book "Dry Strength Additives for Paper", p. 1-32, Ed. W. Reynolds, TAPPI-Press (Technical Association for Pulp and Paper Industry), 1980. (The above publications are herein incorporated by reference.) With this technique nanocoatings are produced on fibers with organized multilayers of polymers (5-100 nm thick) producing positive or negative pulp with increased surface roughness due to the adsorbed polymer loops and free ends. Further, a new approach in paper formation and paper loading has been developed using this modified pulp or by depositing polycation/nanoparticle multilayers on row pre-formed paper.

In the L-b-L process a substrate (paper or cellulose pulp fibers) is immersed in an aqueous solution containing a cationic polyelectrolyte, and a monolayer of polycation is adsorbed. The adsorption is carried out at relatively high concentrations of polyelectrolyte (e.g., higher than 0.01 grams per liter, or higher) so that a number of ionic groups remain exposed to the interface, and thus the surface charge is effectively reversed. Reversed surface charge prevents further polycation adsorption, i.e., a polymer monolayer of ca 1 nm thick is adsorbed. Then the substrate is immersed in a solution containing an anionic polyelectrolyte. Again a layer is adsorbed, but now the original surface charge is restored. By repeating both steps, alternating multilayer assemblies are obtained with precisely repeatable layer thicknesses. Multistep adsorption allows reliable treatment of any surface and design of needed composition across the multilayer is (molecular architecture). The process makes possible the building of ultra thin ordered films in the range of 5 to 1,000 nm with precision better than 1 nm and definite molecular compositions. The procedure is carried out not only with linear or branched polyions, but with proteins, DNA, clay and charged nanoparticles. This is a simple aqueous-medium technique that allows coating with nanometer precision on paper or cellulose fibers, as well as writing with a polyion ink-jet printer on paper to construct lines or letters of special molecular compositions (having unique spectral or other characteristics). The technique may be applied at different stages of paper processing or to modify pre-formed paper with charged polymers, enzymes, DNA, and inorganic nanoparticles (such as clay or magnetite). The prescribed treatment time is normally between about 3 and 5 minutes; there is no limitation on surface area; and the treatment may be included in a standard paper processing line. This processing provides unique features for special types of paper (such as increased strength, varying wettability, improved optical properties, loading paper with pharmaceutical and other materials, etc.) The L-b-L treatment of pulp adds new features in standard paper production technology. For example, by mixing 50% positively-charged L-b-L treated fibers with 50% negatively-charged L-b-L treated fibers the method of this invention has obtained 100% increase in paper strength, as compared with paper prepared with virgin fibers, and 30% increase in paper strength as compared with paper prepared with only positively-charged or only negatively-charged L-b-L treated fibers. L-b-L treated fibers also show superior paper surface properties. For example, L-b-L treatment of mixtures of different fibers with different roughness and uniformity by the method of this invention results in all fibers having more uniform and homogeneous surface characteristics (such as roughness) than products made from the same mixtures of fibers that have not been treated.

It has been found that multiple layers may be formed from almost any type of polyelectrolyte or nanoparticle as long as they carry an opposite charge. The result is that a new area has opened up for fiber and paper modification where the properties of polyelectrolytes may determine the properties of the fibers through ultra thin layers on their surface. These findings permit nanotechnology applications in the field of wood fiber surface engineering that may be performed in a simple way and under environmentally friendly conditions, e.g., at room temperature, neutral pH, and at low salt concentrations. A systematic study of a layer-by-layer nanocoating of pulp lignocellulose fibers and paper for increasing the strength of paper, both in dry state and in wet state, has been performed which adds to the concept of traditional hydrogen bonding interaction the concept of ionic interaction between oppositely-charged ionized groups of fibers coated with polycations and polyanions.

Figure 2:
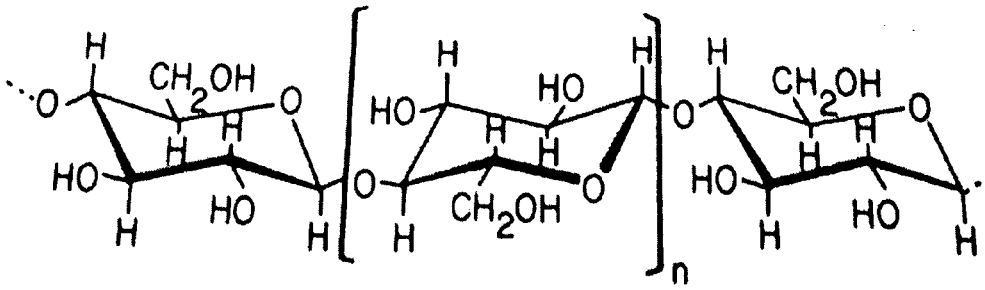
FIG. 2 depicts the chemical formula of the basic component of cellulose fibers.

Despite the common use of dry-strength additives in papermaking (such as polycations, including starch), there is still no mechanism available for explaining the real function of these additives. It has been suggested that the weak link in paper strength is the fiber-fiber bond strength since the fiber strength is greater than the strength of the paper composed of these fibers (See R. Davidson "Theory of Strength Development," in book "Dry Strength Additives for Paper", p. 1-32, Ed. W. Reynolds, TAPPI-Press (Technical Association for Pulp and Paper Industry), 1980; Pulp and Paper. Chemistry and Chemical Technology, book, Editor J. Casey, J. Wiley Publ., New York, 1980, p. 1-750; R. Howartd, C. Jowsey, J. Pulp Paper Sci., v.15, 225, 1989, "The effect of Cationic Starch on the Tensile Strength of Paper,"). See FIG. 2, which shows the formula of basic component of cellulose fiber. It has been suggested that cationic polymers create an increased number of bonds between anionic cellulose pulp fibers. In Stratton R., Colson N., Nordic Pulp Paper Research J., v.4, 245, 1993, "Tensile Strength of Paper" and H. Espy, TAPPI (Technical Association for Pulp and Paper Industry) Journal, v.78, 90, 1995, "The Mechanism of Wet-Strength Development in Paper," the ionic character of interaction of polycation additives to pulp was confirmed, and also it was shown that bond strength between polycation treated fibers corresponds to the strength between cationic polyelectrolytes and anionic fiber cellulose. These results indicate that the external part of the fiber walls (their surface) is very important for creating strong joints between adjacent fibers because the strength of the fibers is twice as much is as the strength of the sheet composed of these fibers. It has been found that, as the joined area between fibers is increased, there is an increase in wet strength of the paper. This result may be achieved either by increasing the contact area between fibers, or by adding a new type of interaction additionally to hydrogen bonding (for example, ionic binding between positive and negative polyelectrolytes immobilized on fiber surface with layer-by-layer assembly). A single treatment of pulp fibers with polycations is a well-known procedure (See L. Odberg, H. Tanaka, A. Swerin, Nordic Pulp Paper Res. J., v.4, 135-140, 1989, "Kinetic Aspects of the Adsorption of Polymers on Cellulose Fibers"; R. Aksberg, L. Odberg, Nordic Pulp Paper Res. J., v.5, 168-171, 1990. During such a process, a recharge of the fiber surface from negative to positive is reached. (The above publications are herein incorporated by reference.)

A method of paper forming by blending negative and positive pulp produced with L-b-L nanocoating is a preferred embodiment of this invention. Another preferred embodiment of the invention is the coating of pulp fibers with nanoparticles in alternation with polycations with controlled loading percentage of between about 0.1% and about 5%. (Loading percentage is the ratio of the weight of used nanoparticles and polymers to the weight of fibers being treated, on a dry basis.) The loading percentage is directly proportional to the number of layers of deposited nanoparticles and it is easily controllable with L-b-L nanoassembly techniques.

Similarly, organized multilayers of enzymes, such as laccase, have been layer-by-layer assembled on wood fibers to provide biocatalyst properties to remove remaining lignin from paper. Accordingly, the method of this invention affords the following innovations: (1) polyelectrolyte nanoassembly on wood fibers to convert their surface charge to positive or negative; (2) paper making from approximately 50% positive and 50% negative fibers and replacing the traditional hydrogen bonding with electrostatic connection between fibers; (3) an application of layer-by-layer nanocoating to broken recycled fibers (mill-broke) to charge them positively (this development affords the use of modified mill-broke addition, e.g., up to 40% mill broke and higher, to virgin pulp during paper making is without any substantial decrease in paper strength; (4) nanocoating fibers with multilayers nanoparticles (such as silica, $TiO_2$, $Al_2O_3$, $SnO_2$, plane and tubule clay nanoparticles) and proteins (such as laccase, glucose, oxidase, hemoglobin and myoglobin); and (5) paper manufacture from nanoparticle or enzyme coated fibers. By judicious control of the pH in their solutions, most of these nanoparticles can be changed from positively-charged to negatively-charged and vise versa.

As an application of the method of this invention two directions of L-b-L assembly for pulp and paper processing—nanocoating on pulp fibers and nanocoating on preformed paper—have been developed with the following standard protocols:

Standard L-b-L assembly procedure on pre-formed paper: As a standard approach to L-b-L-coating on preformed paper the following steps are employed: (1) Take aqueous solutions of adsorbate (polyions, nanoparticles or proteins) at a concentration of 0.1-1 mg/mL, adjust the pH so that components are oppositely charged; (2) Take charged paper sheet (at pH 6-7, its surface potential measured as 40 mV); 3) Carry out the alternate addition of polycation and polyanion solutions to fiber pulps for about 3 to 5 minutes, with intermediate 0.5 minute water rinsing at pH that maintains polyion ionization; 4) Dry using streaming air (if desired). Polyions used in the assembly are as follows: polycations-poly(ethylenimine) (PEI), poly(dimethyldiallyl ammonium chloride) (PDDA), poly(allylamine) (PAH), polylysine, chitosan; polyanions—poly(styrenesulfonate) (PSS), poly(vinylsulfate), poly (acrylic acid), chitosan, starch. Additionally polymers widely used in paper making were studied: carboxymethyl cellulose (CMC), and cationic and anionic starch.

The procedure of polyion assembly on pulp microfibers: Pulp fibers are dead hollow shells of wood cells with diameter ca 20 μm (microns), length of a few millimeters, and surface potential of −40 mV. For the multilayer shell formation, 1% by weight of aqueous microfibers dispersion is added to a beaker, followed by the addition of polyions, to give shell architectures of the following sequence: $(\text{polycation/polyanion})_n$ where n=1, 2, 3, . . . . An example of a typical shell composition is $(PSS/PAH)_{1-5}$. After addition of the polyions, 5 minutes are allowed to elapse for saturation adsorption of the polyions on the colloid particles. The coated fibers then are separated from solution by centrifugation (smaller volumes) or filtration (larger volumes), and the supernatant containing the unadsorbed species is removed. Other methods of washing treated pulp have also been exploited (polyion coating through titration with surface charge monitoring).

Figure 3:
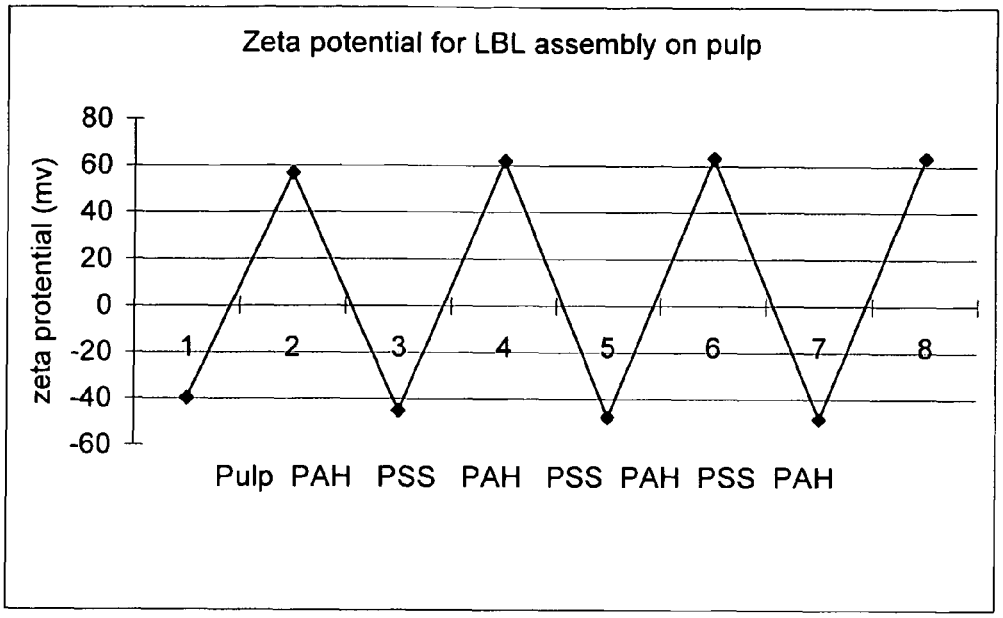
FIG. 3 is a graph showing the results obtained on regular alternation of pulp surface potential from −40 mV to +52 mV and back with step-wise layer-by-layer treatment with poly (styrene sulfonate) and poly(allylamine).

A procedure has been developed to systematically change surface charge and roughness of the pulp lignocellulose fibers. First, the coating conditions (polyion types, concentrations, time of deposition, pH, layer thickness and roughness) are elaborated and optimized on QCM electrodes with Quartz Crystal Microbalance monitoring. For preliminary nanocoating experiments, the standard L-b-L conditions described above are used. Then, these conditions are transferred for coating on microfibers. FIG. 3 gives results on regular alternation of pulp surface potential from −40 mV to +52 mV and back with step-wise L-b-L treatment with poly (styrene sulfonate)—PSS and poly(allylamine)—PAH. Treatment with other linear or branched polyions [e.g., PDDA-poly(dimethyldiallyl ammonium chloride), PEI—poly(ethylenimine), PAA—poly(acrylic acid)] gives similar results. Every step of polycation/polyanion deposition adds ca 5 nm thickness to the coating layer as it is controlled with Quartz Crystal Microbalance measurements. The total thickness of the multilayer coating shown in FIG. 3 is ca 17 nm. Multistep L-b-L polyion treatment has an advantage in producing uniform coatings (as it was shown in V. Tsukruk, V. Blyznyuk, Visser, D.; Campbell, A.; Bunnig, T.; Adams, W. Macromolecules, 1997, v.30, 6615-6625, "Electrostatic deposition of polyionic monolayers on charged surface"), because initially patchy coating located around only highly charged spots spreads over larger area with applying 2-3 adsorption cycles. Increasing ionic strength of polyion solutions in the range of 0.1-1 Molar will result in polymer coil formation which, in application to L-b-L assembly, will result in increase of the film growth step (wet) from 5 nm to 10-20 nm allowing optimization of the coating. See G. Decher, Science, v.27, 1232-1237, 1997, "Fuzzy nanoassemblies: Toward layered polymeric multicomposites"; and "Protein Architecture: Interfacial Molecular Assembly and Immobilization Biotechnology", Editors: Y. Lvov and H. Mohwald, 2000, Marcel Dekker Publ., NY, p. 1-394. Chapters 4-7. (The above publications are herein incorporated by reference.)

Figure 4A:
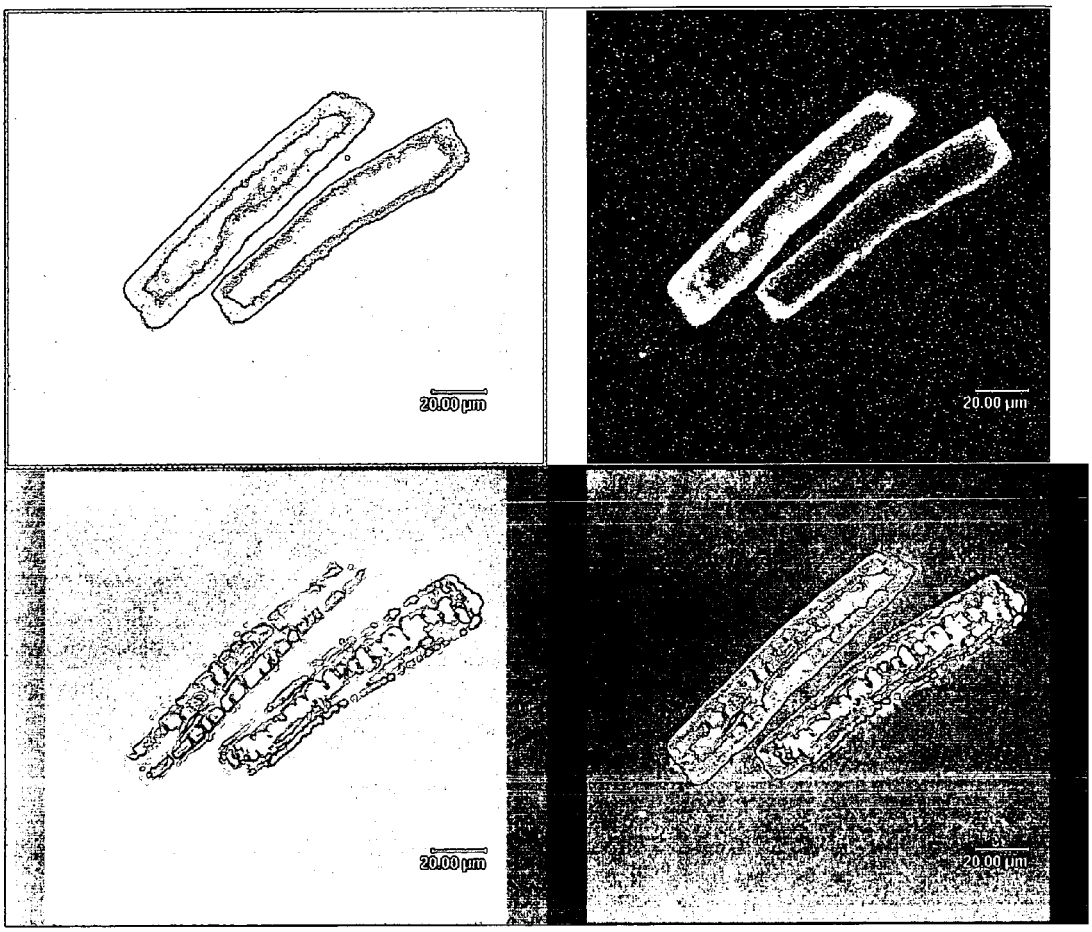
FIG. 4(*a*) and FIG. 4(*b*) show laser confocal longitudinal images of IP Augusta Hardwood pulp lignocellulose fibers coated with two bilayers of FITC-labeled PAH and RBITC-labeled PSS, respectively.
Figure 4B:
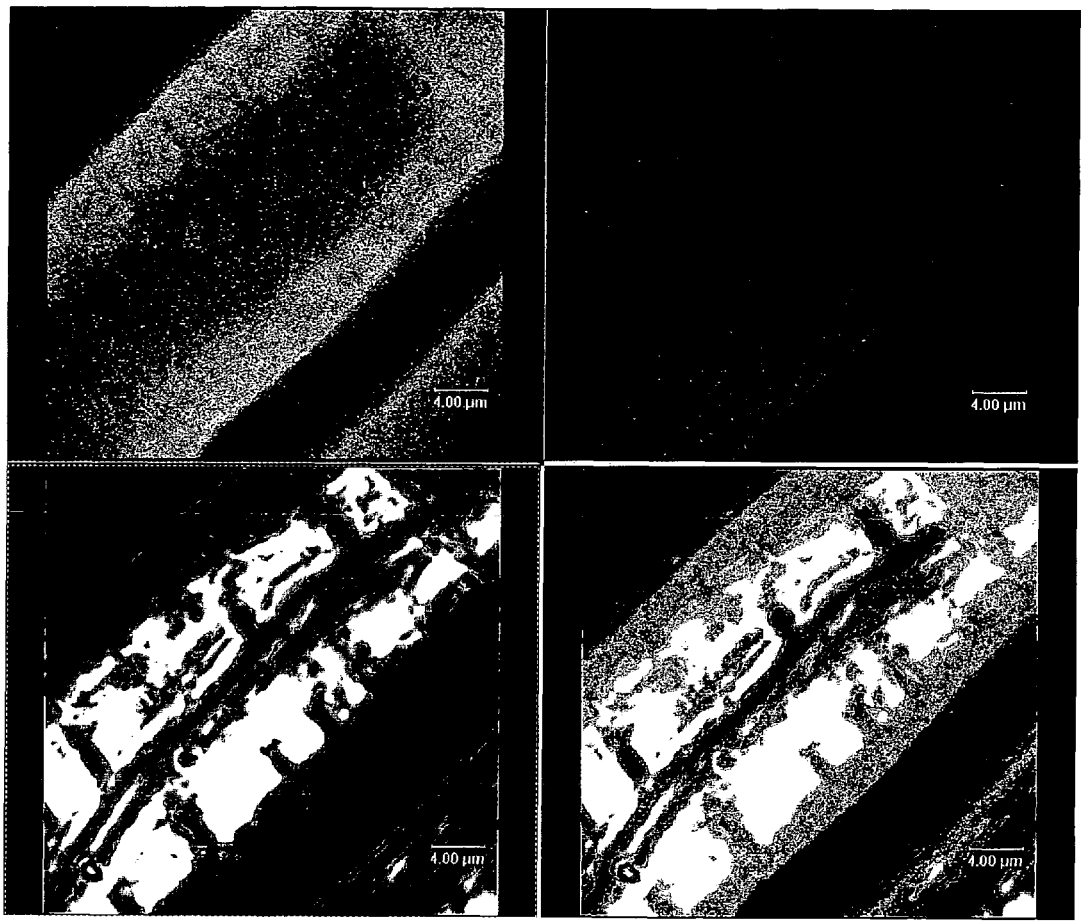

A powerful method for analysis of nanocoating on fibers is confocal laser scanning microscopy based on excitation of fluorescent in certain positions (cross-sections) of the micro-objects. Therefore, by coating pulp fibers with fluorescently labeled polymers, coating location may be imaged in or out of fibers, and to visualize fiber details, such as internal wood-cell wall structures like pits, micro-fibril orientations, and micro-crystalline failures. FIG. 4(*a*) and FIG. 4(*b*) give the results on analysis of L-b-L coating on pulp fiber. The fibers were coated with two bilayers of FITC (green) labeled PAH and RIBTC (red)-labeled PSS, using methods known in the art. FIG. 4(*a*) and FIG. 4(*b*) show laser confocal longitudinal images of pulp lignocellulose fibers coated with two bilayers of FITC-labeled PAH (green fluorescence) and RBITC-labeled PSS (red); the lower images are the same images at non-fluorescent mode (IP Augusta Hardwood pulp was used); scale bar is 20 μm, left, and −4 μm, right; Instrument used was Laser Scanning Confocal Microscope, Leica SP2. At higher magnification, one can see uniform ca 100-nm thickness coating on the surface of the fiber which bridges over pit openings. Pit's canals of ca 200-nm diameter are well visible at the upper right images. Therefore, L-b-L coating protects the cellulose cell walls from water absorption and gives added stability to the fibers and papers made from them. Improved dimensional stability is very important to today's graphical printing methods.

Figure 5A:
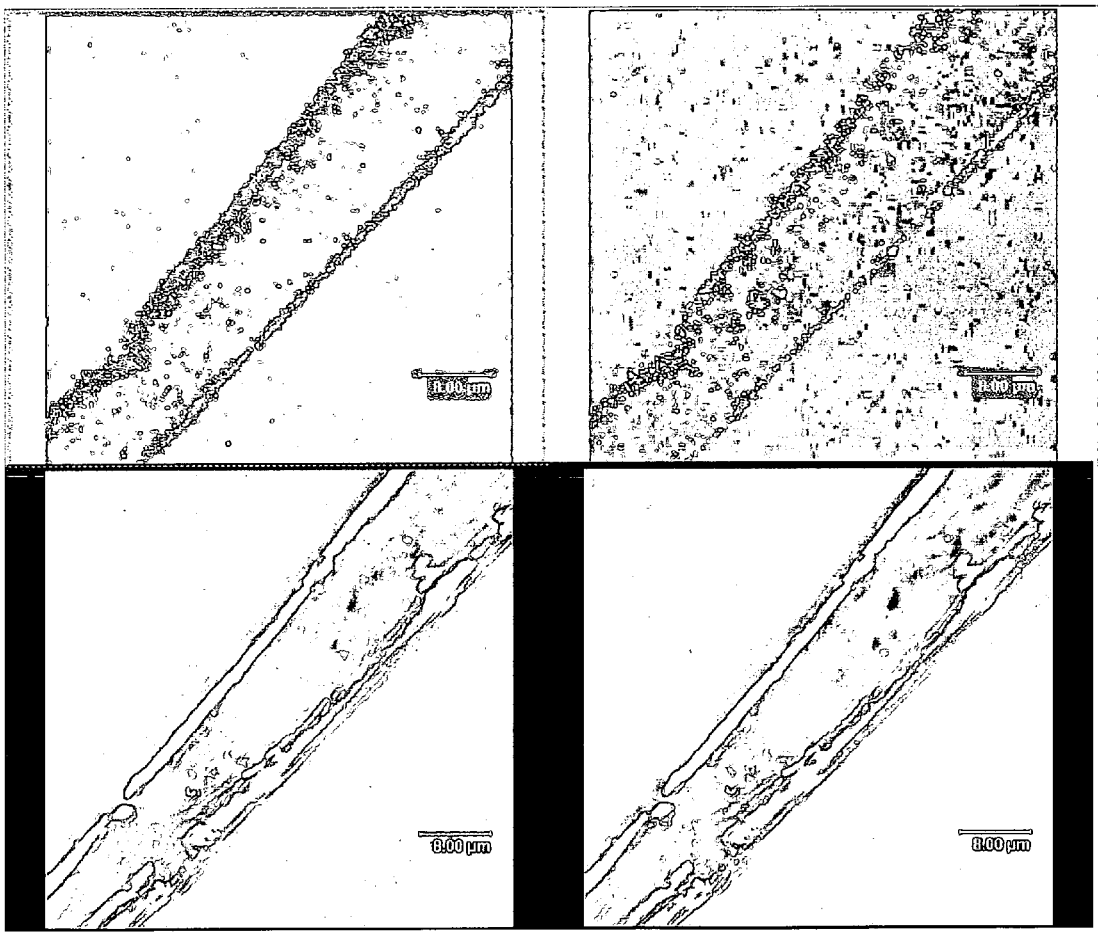
FIG. 5(*a*) is a laser confocal image of non-treated IP Augusta Hardwood pulp fibers.
Figure 5B:
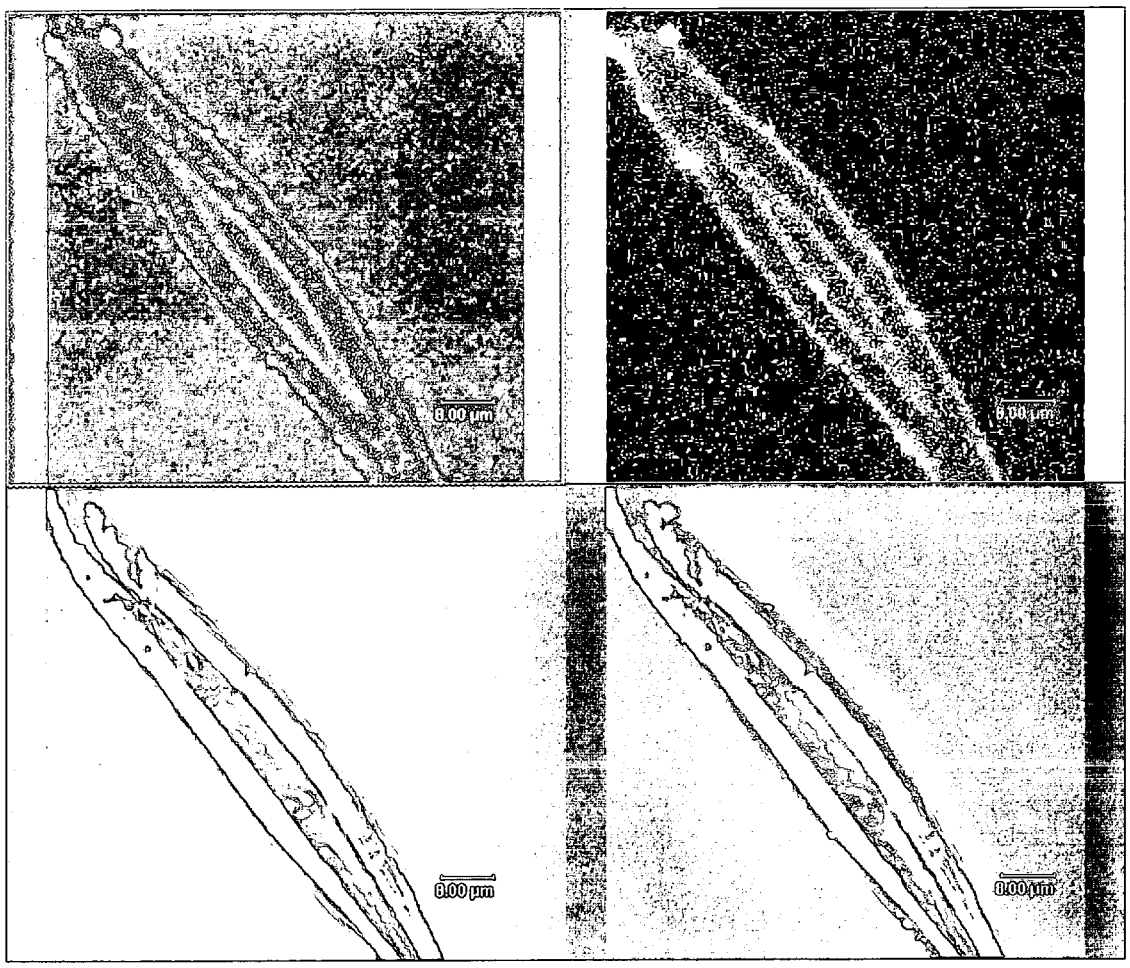

To show the observed fluorescence only from the polyion coating, an image of non-coated pulp fibers is submitted (FIG. 5(*a*), upper panels). FIG. 5(*a*) to and FIG. 5(*b*) show laser confocal images of non-treated pulp fibers (FIG. 5(*a*)), and 5 min FITC-PAH/RIBTC-PSS/FITC-PAH/RIBTC-PSS alternate adsorption (FIG. 5(*b*)) (IP Augusta Hardwood pulp); scale bar is 8 μm; instrument used was Laser Scanning Confocal Microscope, Leica SP2. One cannot see any fluorescence but good usual optical image of the same object was observed (FIG. 5(*a*), lower panels). After deposition of FITC-PAH/RIBTC-PSS/FITC-PAH/RIBTC-PSS the coating fluorescent signal became visible (FIG. 5(*b*)). Time of the adsorption and molecular weight of the used polymers should be optimized for better coating.

Figure 6:
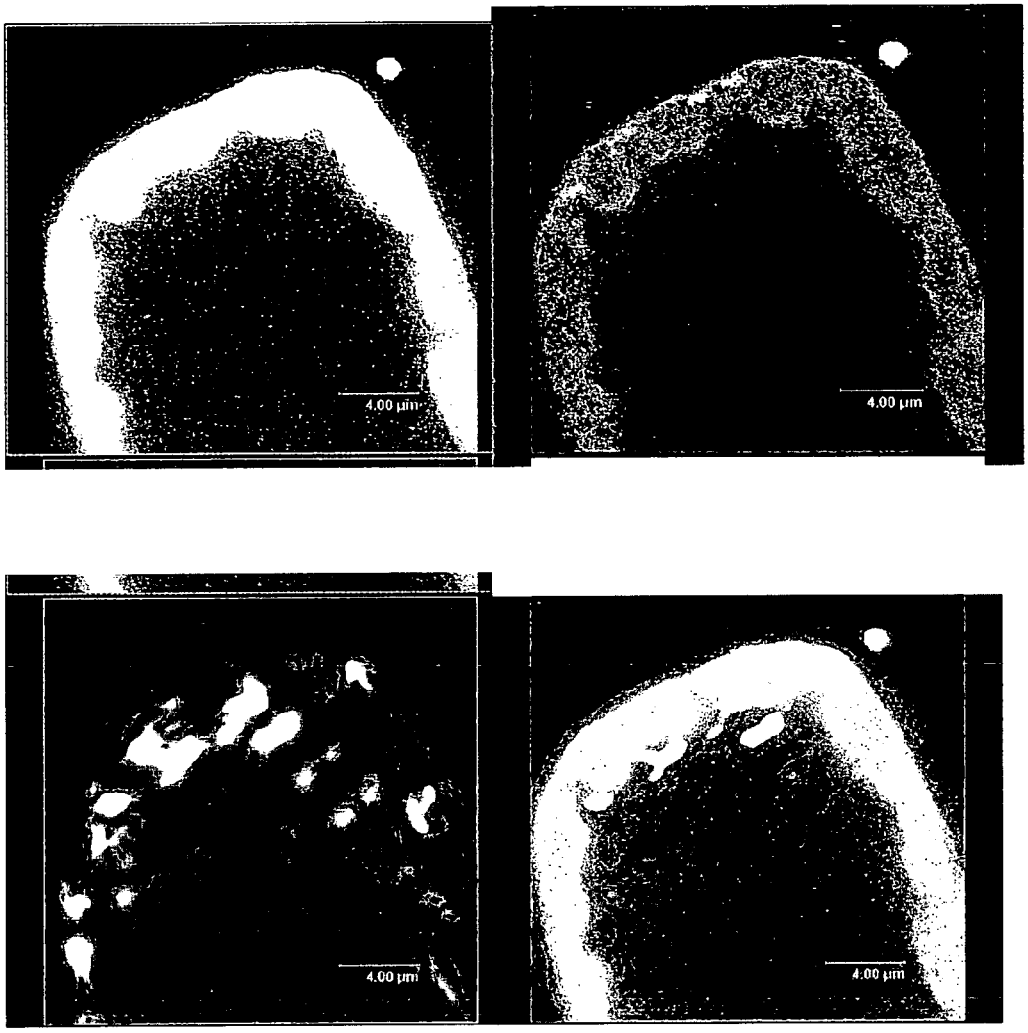
FIG. 6 shows a confocal image of cross-section of 20-micron-diameter IP Augusta Hardwood pulp fibers coated with fluorescently labeled polyions with composition of (FITC-PAH/RIBTC-PSS/FITC-PAH/RIBTC-PSS).

FIG. 6 shows confocal image of cross-section of 20 micron diameter pulp fibers coated with fluorescently labeled polyions with composition of (FITC-PAH/RIBTC-PSS/FITC-PAH/RIBTC-PSS). IP Augusta Hardwood pulp was used. Scale bar—4 μm, instrument: Laser Scanning Confocal Microscope, Leica SP2. Again, one can see coating bridging the pits and fiber wall folds.

Figure 7A:
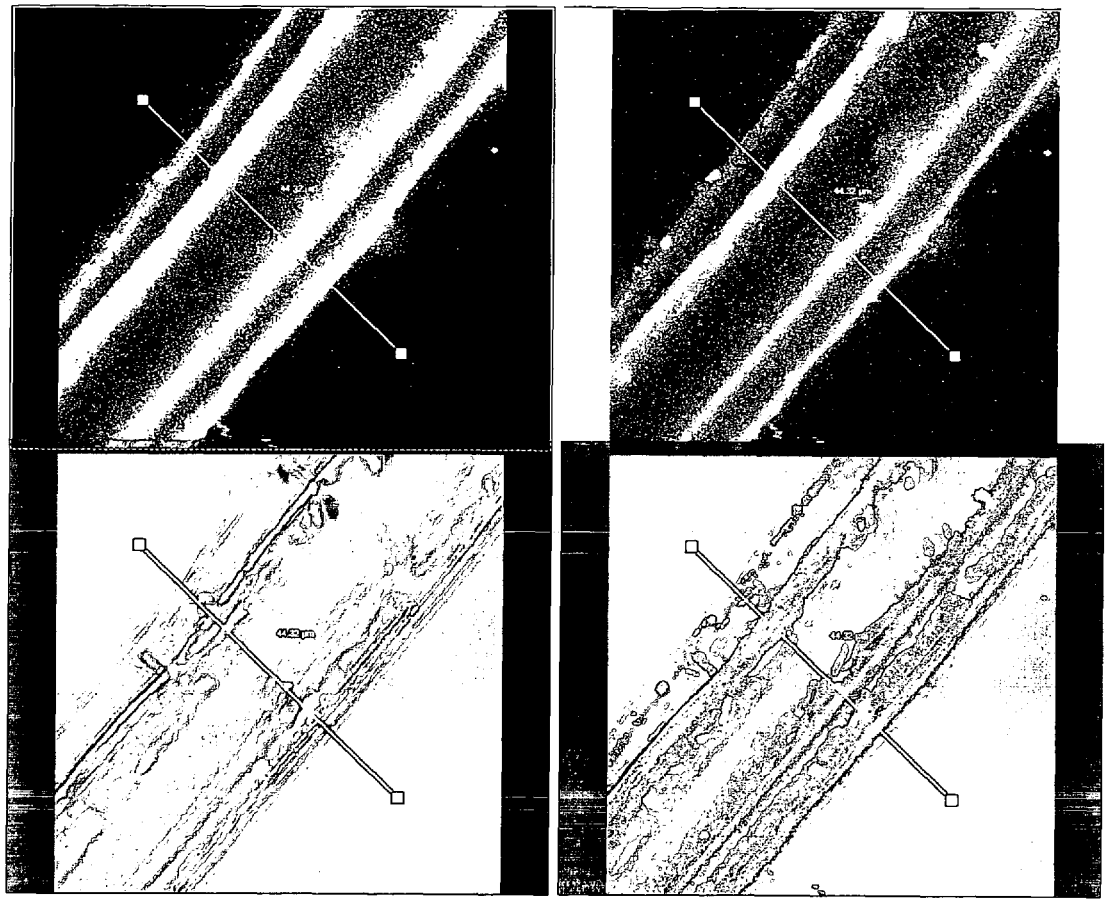
FIG. 7(*a*), FIG. 7(*b*) and FIG. 7(*c*) show confocal longitude cross-section images of soft wood pulp tubule fibers coated with different polyions and nanoparticles.
Figure 7B:
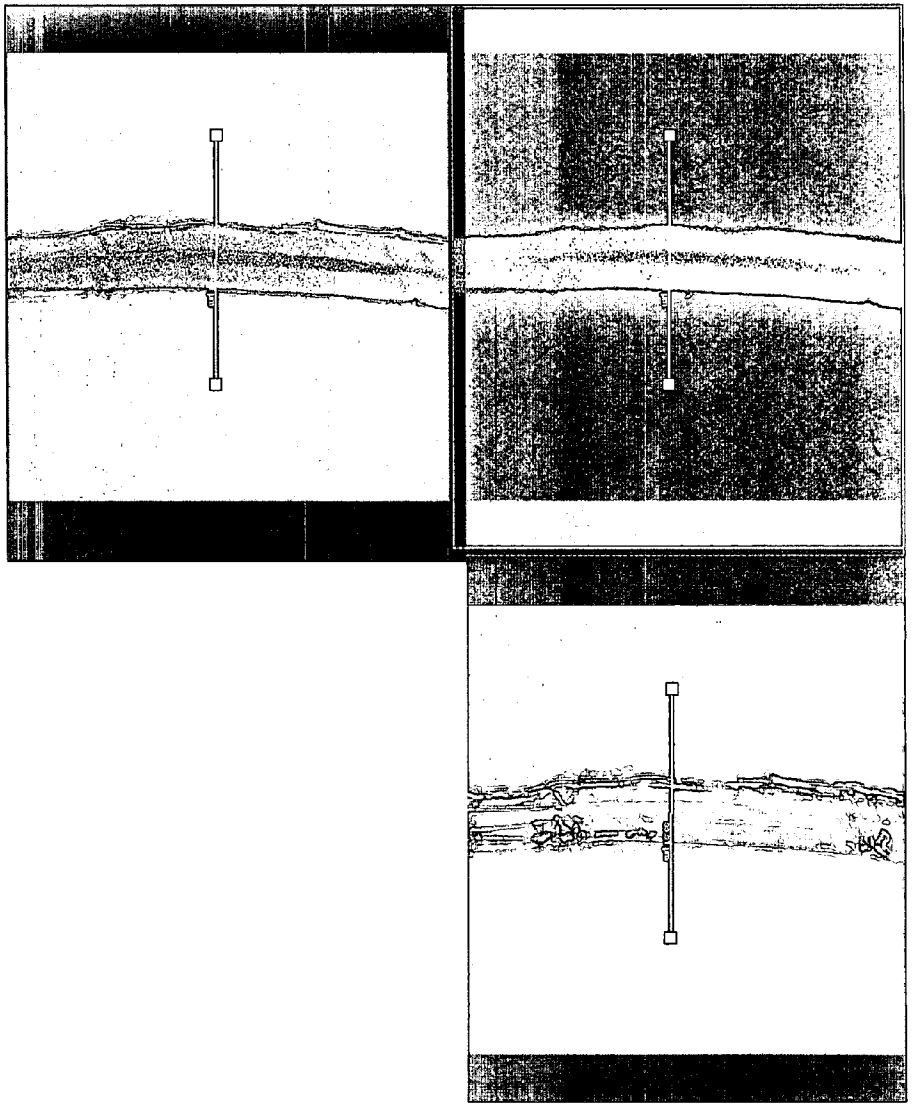
Figure 7C:
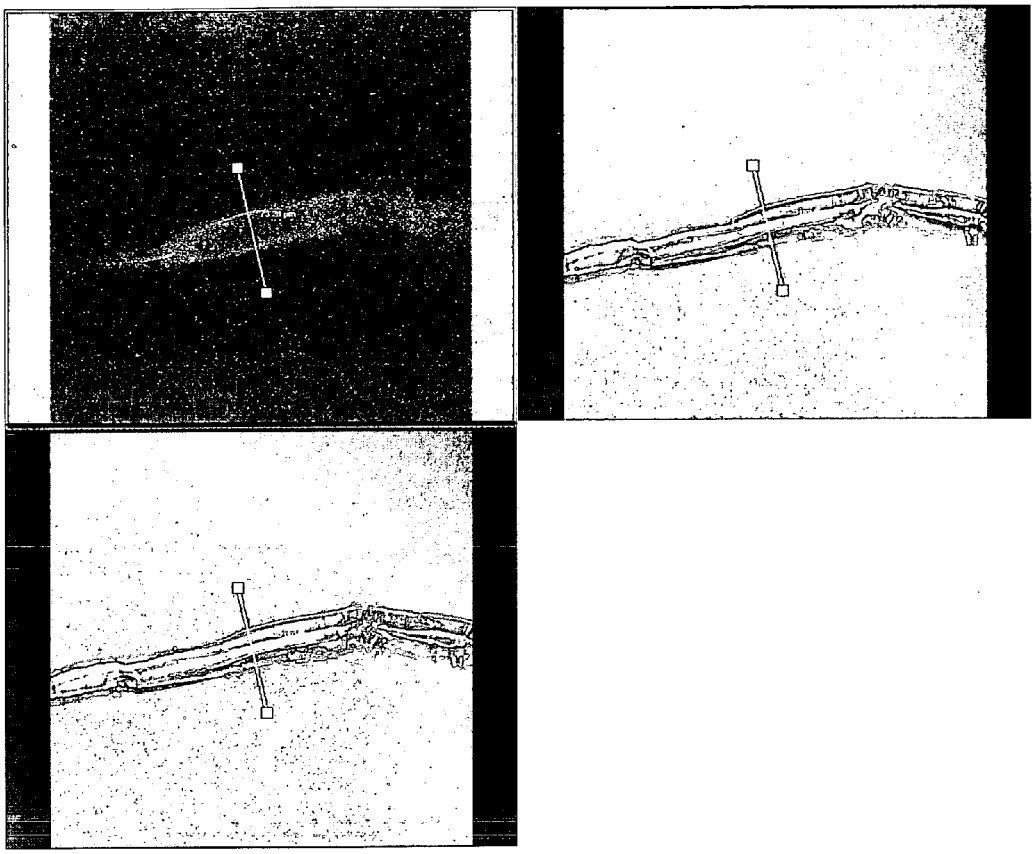

Results of optimization of linear polyion and nanoparticle coating for pulp fiber modification: Polymer molecular weight (MW) tried: 10 kD, 50 kD, 70 kD, 150 kD, 300 kD.—higher MW, e.g., above 70 kD gives better coating (10 kD does not work). FIG. 7(*a*), FIG. 7(*b*) and FIG. 7(*c*) show polymer molecular weight optimization: confocal longitude cross-section image of soft wood pulp tubule fibers (soft wood) coated with two bilayers of PAH(70k)/PSS(70K) (FIG. 7(*a*)); PDDA (150 kD)/PSS (70 kD), coating thickness is 150 nm (FIG. 7(*b*)); and PAH(8 kD)/PSS(70 kD) (FIG. 7(*c*)). Compositions of PSS/PAH and PSS/PADDA appeared to give better coatings.

Figure 8:
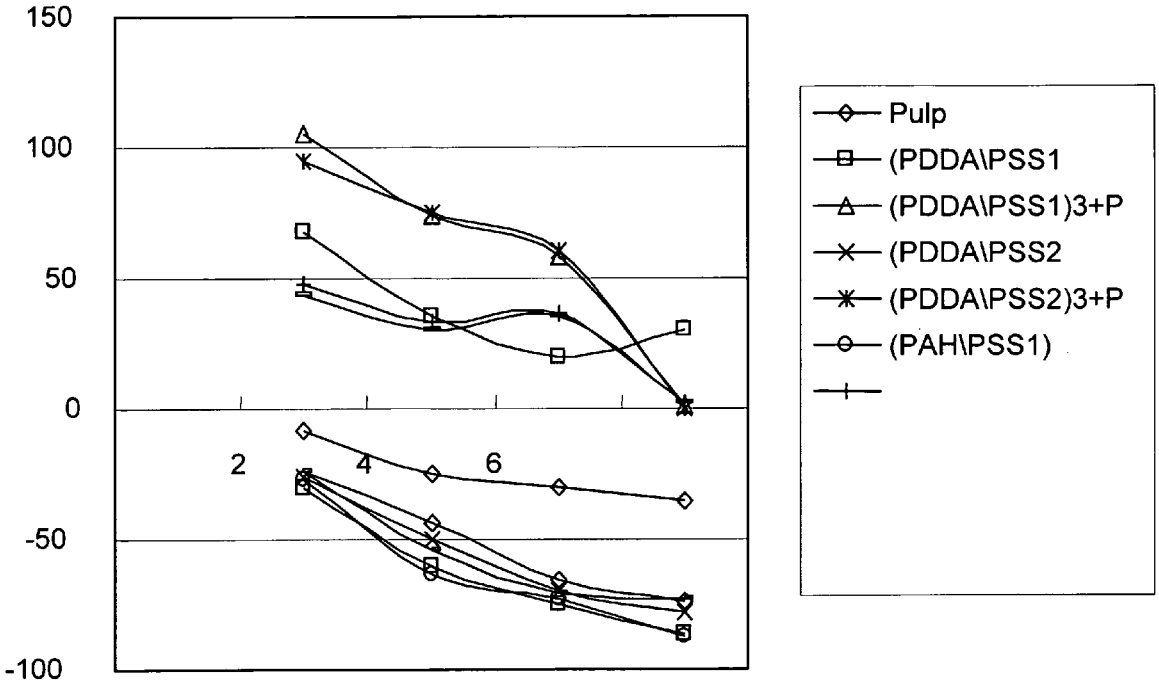
FIG. 8 is a graph illustrating pH optimization for negative (poly(styrene sulfonate) terminal layer) and positive (poly (dimethyldiallyl ammonium chloride) terminal layer) coating; the vertical axe showing a plot of the fiber surface charge in mV, and the horizontal axe showing a plot of the solution pH, while various coating compositions are shown on the right.

PH optimization: The best pH for nanocoating is between 4 and 8. There is no need for precise pH control in this region (see FIG. 8). FIG. 8 illustrates pH optimization for negative (PSS terminal layer) and positive (PDDA terminal layer) coating; vertical axis—fiber surface charge in mV, and horizontal axis—solution pH; the coating composition is presented in the right section of the figure.

Figure 9:
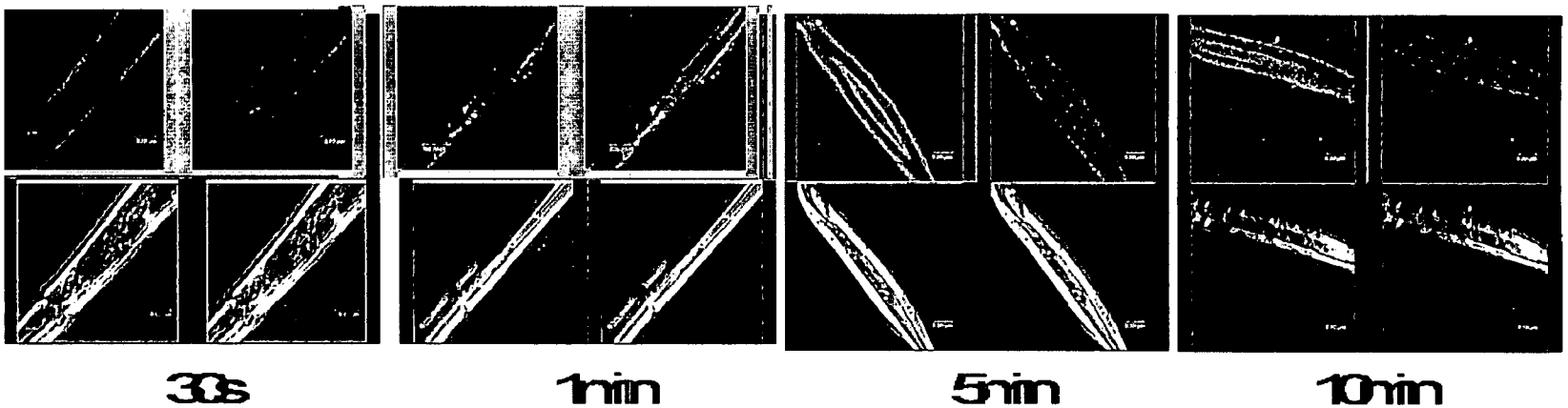
FIG. 9 shows results of tests conducted to optimize the length of deposition time used in the layer-by-layer coating technique of the invention.

Time of deposition tried: 1, 3, 5, 10, 15 and 30 minutes—preferably using a time of 10 minutes or more (FIG. 9). FIG. 9 shows L-b-L coating time to optimization (confocal images, colored-coating polymer). Stable coating may also be reached with deposition times of more than 5 minutes.

Figure 10A:
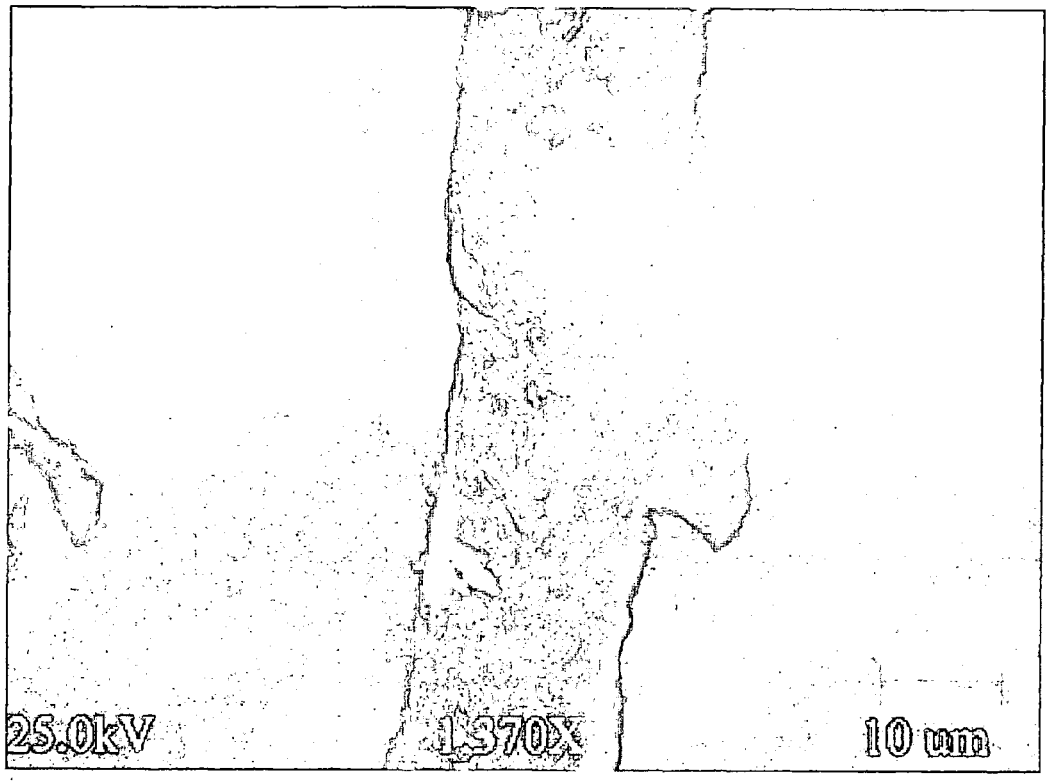
FIG. 10(*a*) and FIG. 10(*b*) show scanning electron microscopy images of nanoparticle layer-by-layer coating on pulp fibers.
Figure 10B:
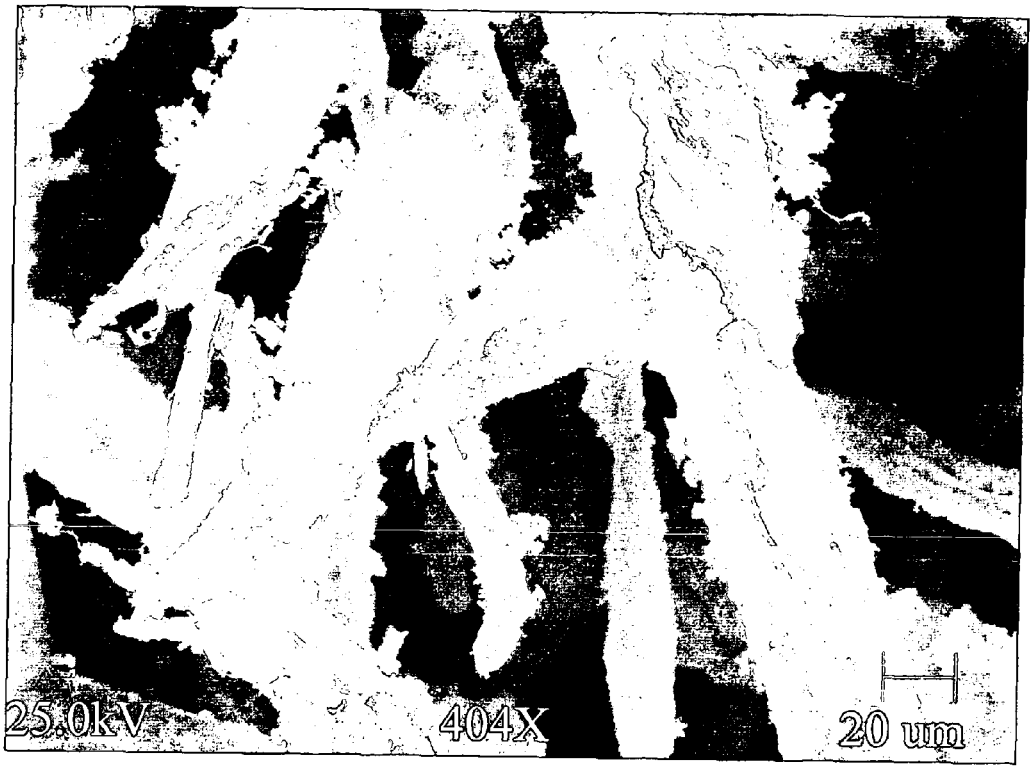

Nanoparticle pulp fiber coating. FIG. 10(*a*) and FIG. 10(*b*) show SEM-AMRAY images of nanoparticle L-b-L coating on pulp fibers: Hallosites clay coating (FIG. 10(*a*)) and 30-nm diameter $TiO_2$ coating (FIG. 10(*b*)). Paper making is carried out from positively and negatively L-b-L treated pulp to include electrostatic attraction to enhance paper strength.

After L-b-L treatment, pulp was used in the paper making process with emphasis on the following features for better properties: (1) optimization of the coating thickness in the range of 10-100 nm; (2) optimization of the coating composition using linear or branched polyions and nanoparticles, and using natural polysaccharides such as chitosan, polypeptides and DNA; (3) working with negative or positive pulp for paper production; (4) mixing positively and negatively-charged pulp for paper making.

Figure 11:
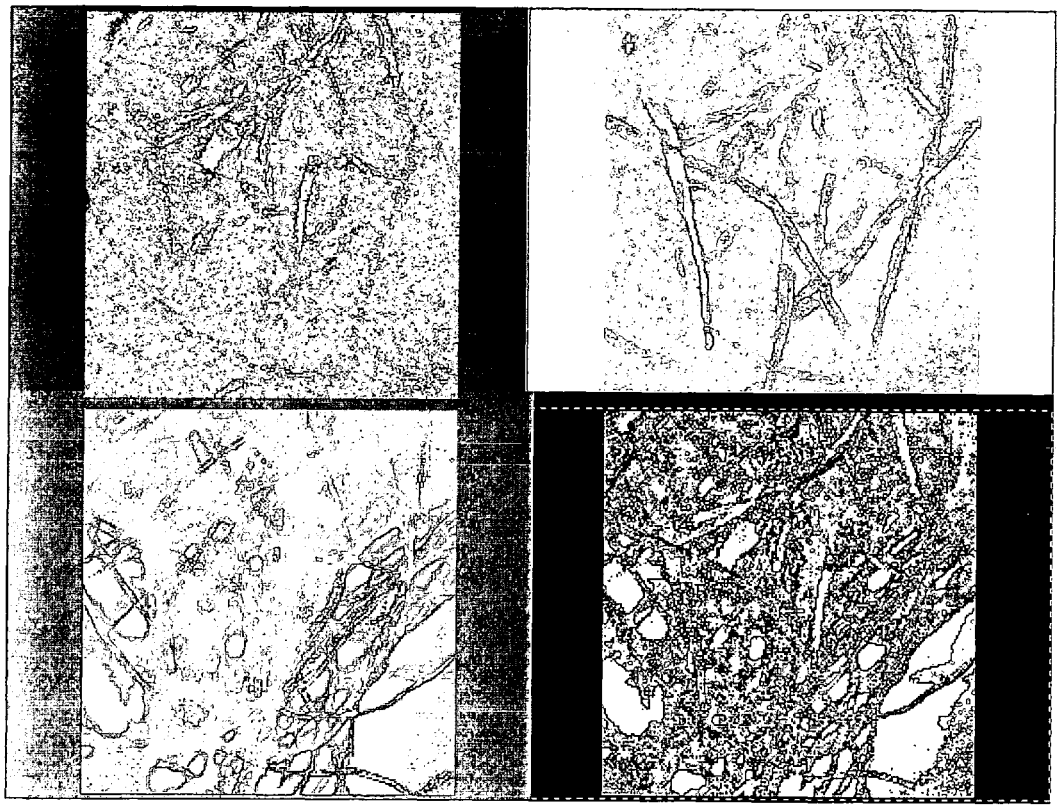
FIG. 11 shows confocal images of mixtures of positive and negative pulp fibers coated with compositions of (PAH/RIBTC-PSS/PAH/RIBTC-PSS) and (FITS-PAH/PSS/FITC-PAH), and illustrates results obtained from mix of positive and negative fibers.
Figure 12A:
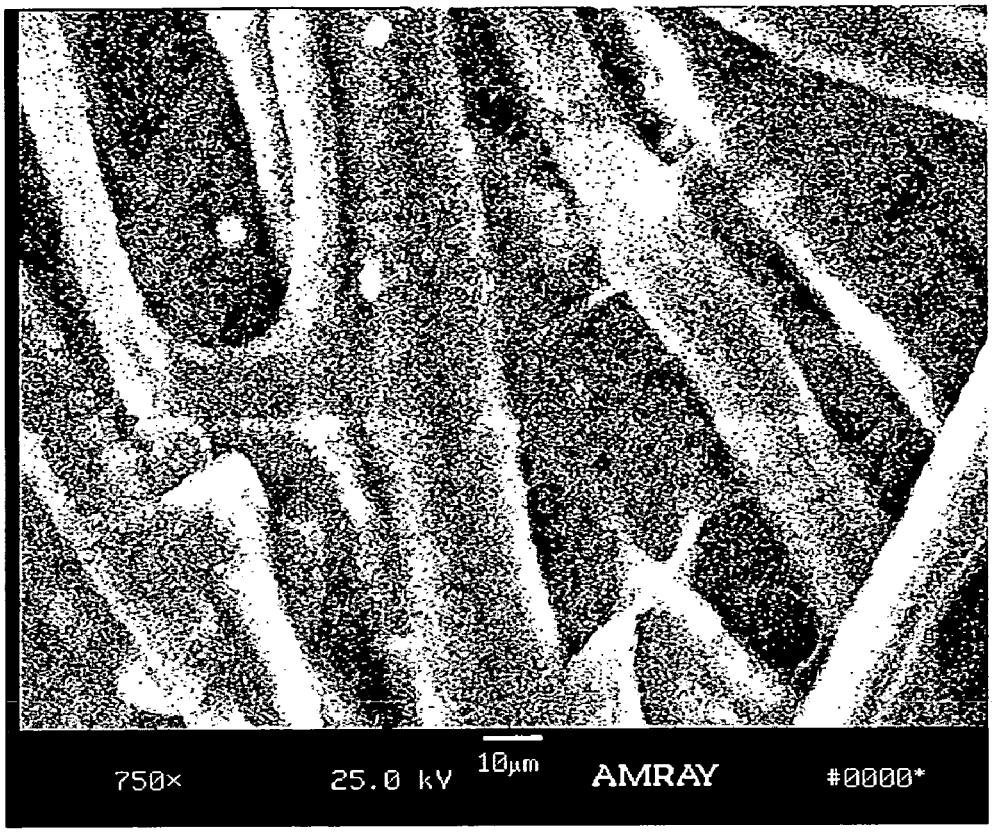
FIG. 12(*a*), FIG. 12(*b*), FIG. 12(*c*) and FIG. 12(*d*)) are scanning electron microscopy images of treated and untreated paper illustrating the results of tests conducted to determine the effectiveness of layer-by-layer nanocoating on preformed paper using different layer thicknesses and molecular level compositions.
Figure 12B:
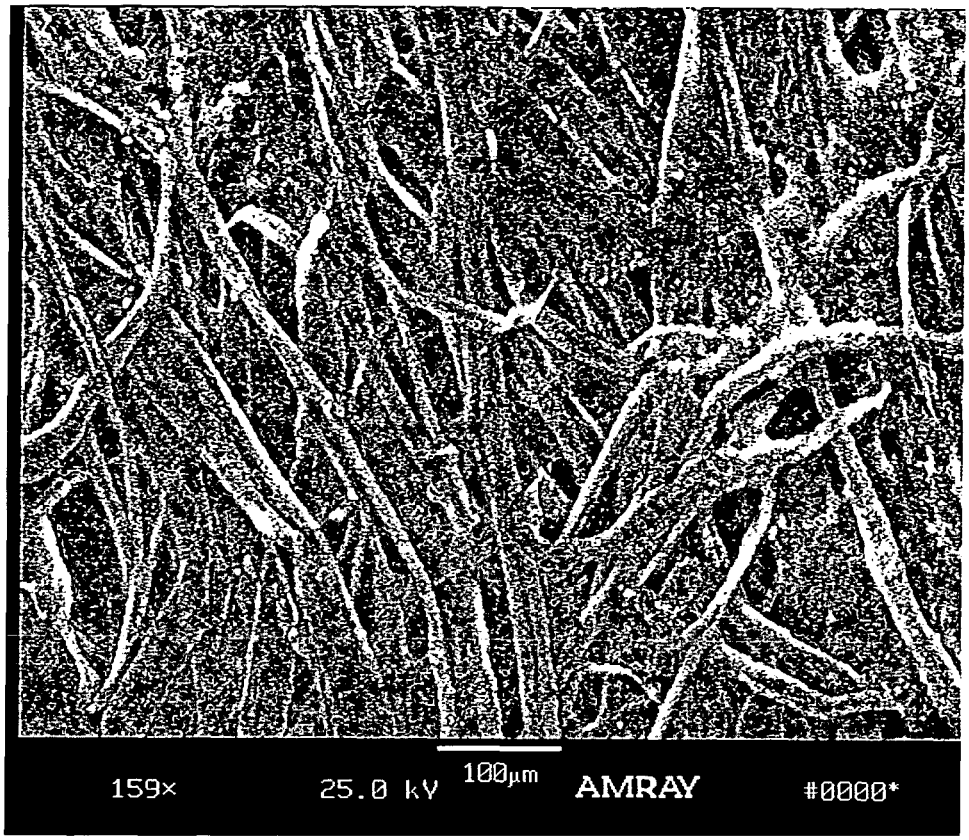
Figure 12C:
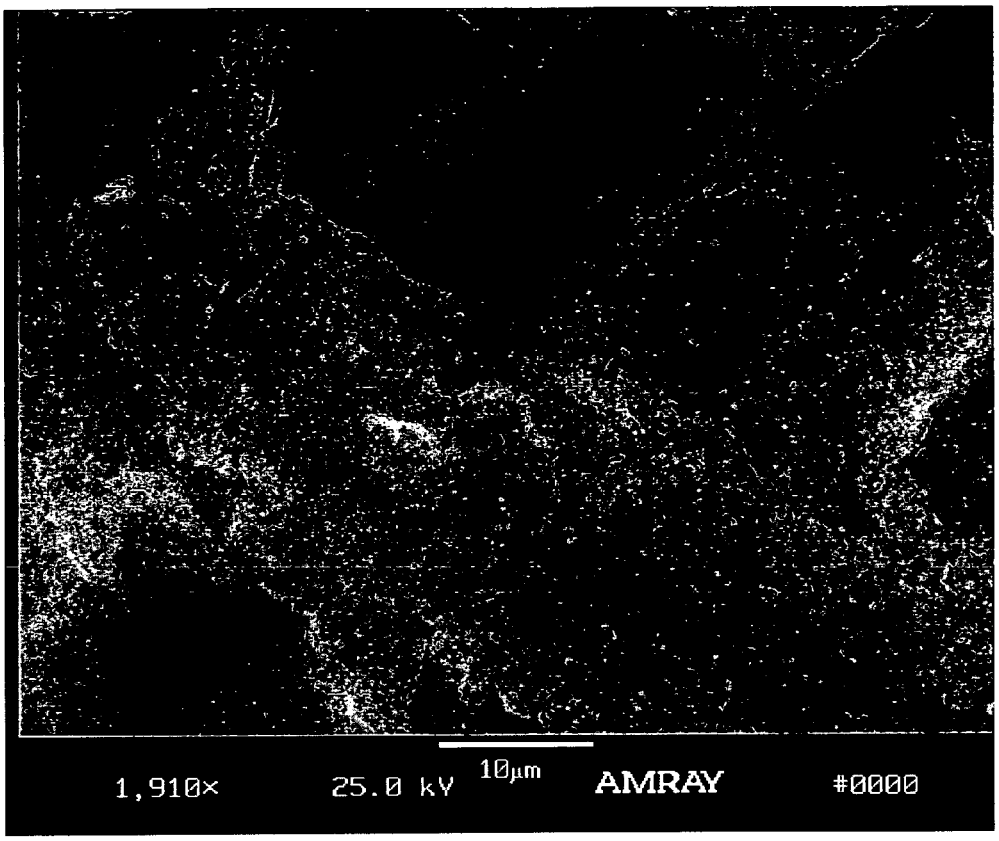
Figure 12D:
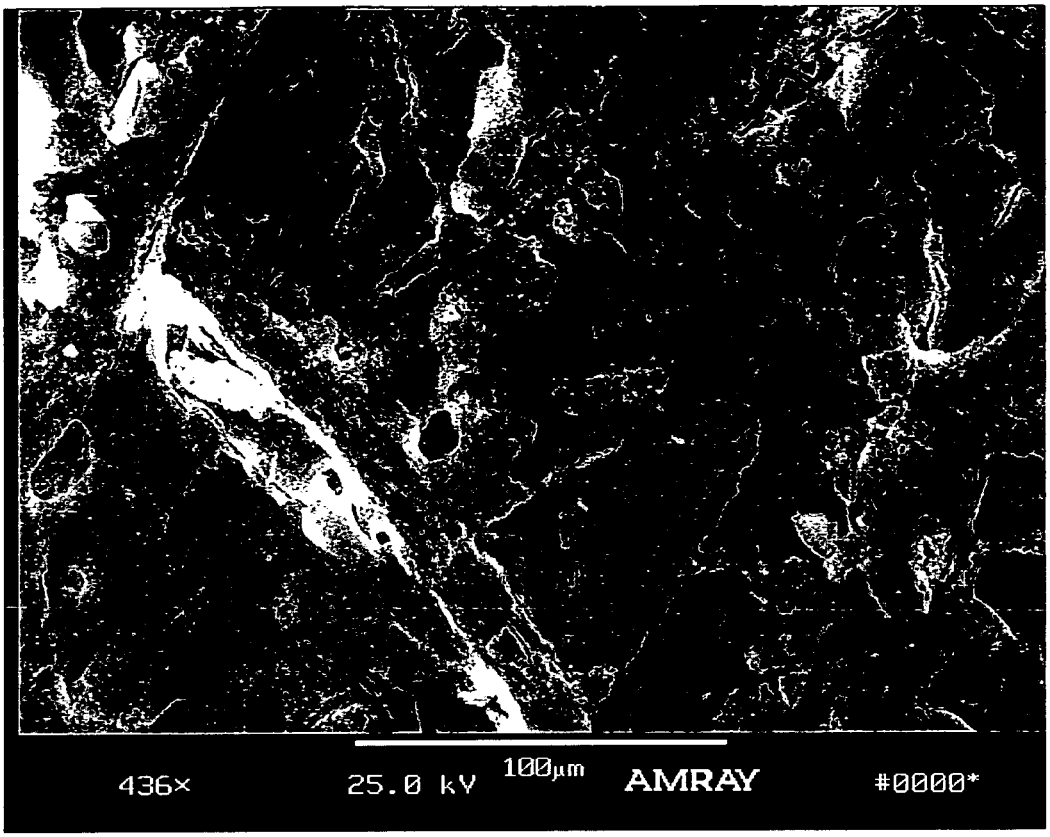

Results on mix of positive and negative fibers are detailed in FIG. 11, which shows confocal images of the mixture of positive (green) and negative (red) pulp fibers (mixing ratio 1:1 by weight) coated with composition of (PAH/RIBTC-PSS/PAH/RIBTC-PSS) and (FITS-PAH/PSS/FITC-PAH); upper images—only FITC fluorescence, only rhodamine fluorescence; lower images—real image, and both rhodamine and FITC fluorescence exited; IP Augusta Hardwood pulp was used, instrument: Laser Scanning Confocal Microscope, Leica SP2. Paper formed from such mixed pulp has shown better strength, up to 300% increase in strength.

Nanocoating on Preformed Paper: One can use a layer-by-layer technique to form an ultra thin polymer coating on pre-formed paper. With L-b-L techniques one may adjust this layer's thickness and molecular level composition in the unique way which is not possible to reproduce without the technology. One may deposit on the surface of the paper different nanoparticles. Additionally, one may convert a surface charge of these nanoparticles from usually negative to positive. In particular, one may deposit positively-charged monolayers of silica, $TiO_2$ or other coating on paper. FIG. 12(*a*), FIG. 12(*b*), FIG. 12(*c*) and FIG. 12(*d*)), illustrate the results: Scanning electron microscopy ("SEM") images of untreated white paper (FIG. 12(*a*) and FIG. 12(*b*)), and paper coated with two bilayers of 78-nm diameter silica and with 3 bilayers of 12 nm magnetite alternated with polycations (FIG. 12(*c*) and FIG. 12(*d*)); loading rate was 2% by weight (of is combination of silica and magnetite); scale bar—10 μm, instrument: AMRAY-1830 SEM.) Such silica-core polymer-cover structures will better adhere negatively-charged ink to paper. With the layer-by-layer technique, one may control the coating layer's thickness and charge, which are important for control of the ink drop's absorption process. Other inorganic nanoparticles (including natural montmorillonites, kaolinates and hallosites) also were applied in the L-b-L paper coating. FIG. 12(*c*) and FIG. 12(*d*) show scanning electron microscopy images of L-b-L paper coating with two bilayers of 78-nm diameter silica and with 12-nm diameter magnetite. For comparison, see also the images of the uncoated paper. One can see that L-b-L coating gives an even coating on fibers, and this coating may have one, two, three or more nanoparticle monolayers. One is able to produce controlled nanoparticle paper coatings with loading rate in the range of 0.5 to 3% by weight.

Using the method of the invention ultra thin layers of biological objects, such as proteins and DNA, were deposited on paper in precise manner with exactly known number of molecular layers. Biomacromolecules in such ultra thin layers have extended functional and storage properties, and may be functional much longer than the ones just deposited on paper. For example, glucose oxidase immobilized through layer-by-layer in alternation with PEI on paper has shown enzymatic stability on a level of 90% of the initial stability after 3 month storage at 5° C. DNA in L-b-L multilayer preserved its native double helix configuration.

Layer-by-layer nanoassembly is based on aqueous polymer solutions, and is environment friendly. Layer-by-layer nanoassembly facilitates (1) the re-use of paper fiber by recovering fibers broken during paper recycling and obtaining better bonding through L-b-L coating; (2) the reduction in use of glues for holding particle board together; (3) a reduction in clay and silica material required for coating paper; and (4) a reduction in bleaching by use of specially designed white layers. The increased use of recycled fiber in production of corrugated board has characterized the demand for additives or treatment that enhances wet and dry strength of the papers. There is also a need for treatment which is stable under alkaline conditions (pH 8-10) since most of strength additives currently in use have their best efficiency between pH 4 and 7 (L. Gardlund, J. Forstrom, B. Andreasson, L. Wagberg, Proceedings of 5th International Paper and Coating Symposium, Baden-Baden, 19 Sep. 2003, p. 233-238, "Influence of Polyelectrolyte Complexes on Strength Properties of Papers Made from Unbleached Pulps"; S. Barsberg, K. Nielsen, Biomacromolecules, v.4, 64-69, 2004 "Pulp fiber monitoring by confocal Laser scanning microscopy—Implication to lignin autofluorescence"; "Application of Wet-End Paper Chemistry", Ed. Che On Au, Ian Thorn, Blackie Academic, London, New York, 1995, pp. 1-198.)

Enhanced Strength for Paper Made from Mixture of Oppositely Charged L-b-L-Coated Pulp: L-b-L assembly directly onto lignocellulose pulp allowed controlled modification of individual fibers surface charge and roughness. Then, the modified fibers were used in paper making in order to enhance its properties. As shown in FIG. 11, the positively-charged pulp is green and the negatively-charged pulp is red (upper part of the figure). By mixing the two different pulps together, a stronger fiber to fiber interaction between them can be achieved. FIG. 11 also shows confocal images of a mixture of positive (green) and negative (red) fibers coated with a composition of $(PAH/RIBTC\text{-}PSS)_2$, (FITS-PAH/PSS/FITC-PAH); upper images—only FITC fluorescence (left), only RIBTC fluorescence (right), lower images—transmission image (left), and superposition of both RIBTC and FITC fluorescence (right). Bar—200 μm.

Hand sheets made in the laboratory from mixing differently charged pulp fibers (as described above) show improved strength properties. The tensile strength test results are shown in FIG. 13. Hand sheets made from original virgin fibers without any modification had an average tensile strength of 24.1±0.2 N·m/g (Newton×meter/gram). Hand sheets made from 50%-50% mixtures of to the original fibers with negatively and positively-charged L-b-L-coated fibers, had an increased tensile strength of 32.8±0.2, and 38.5±0.2 N·m/g, respectively. All data were normalized on paper weight. Therefore, tensile strength increases of 36% for virgin/negative and of 60% for virgin/positive pulp mixtures were achieved. Larger increases for virgin/positively coated pulp may be expected is taking into account enhanced electrostatic interaction between oppositely-charged fibers.

The hand sheet made from mixing positively and negatively L-b-L-treated virgin fibers resulted in a 120% tensile strength increase over unmodified paper and had a strength value of 53.0±0.3 N·m/g. One may conclude that an attraction between oppositely-charged pulp fibers results in enhanced interaction and gives increased paper tensile strength. This phenomenon was more distinct for paper made from mixture of negative and positive fibers both coated with polyelectrolyte multilayers, as compared with paper made from uncoated (virgin) negative pulp mixed with L-b-L-coated positive pulp. This doubled strength of the paper made from nanocoated fibers, indicates a significant progress in paper making. Probably, an attraction between fibers coated with loosely packed and open to water polycation and polyanion chains is stronger than the interaction of polycations packed into the lumen cellulose fibers. From SEM studies of the paper hand sheet edges after tensile tests, one may conclude that in L-b-L-modified paper breaks come mostly through the fibers. In paper from untreated virgin pulp fibers breaks occur due to fibers pulling apart. These results confirm that L-b-L modification of the pulp fiber with polyelectrolyte and nanoparticle coating produce stronger and higher quality paper. FIG. 13 shows the tensile strength test results (TAPPI T494-014-88 standard) of hand sheets made from L-b-L-coated fibers of $(PAH/PSS)_{3\text{-}3.5}$ compositions and their mixtures with untreated pulp fibers (an experimental error in tensile strength is ±0.5 N m/g)

Paper from L-b-L-Coated Broken Fibers: Broken softwood pulp fibers were prepared by chopping paper and passing paper fragments through a 20-mesh giving average fiber length of 0.5 mm which is approximately 20% of normal virgin pulp length. The broken pulp was coated with $(PAH/PSS)_2$ or $(PAH/PSS)_2$+PAH multilayer to make it negative or positive. Paper was then made from these fibers. Tensile tests have shown ca 30% increase of paper strength for L-b-L modified pulp. Therefore, L-b-L coating improves the recycling process. Of particular interest is the blending of virgin pulp and broken pulp of opposite surface charges which produces paper of even higher strength.

The application of the method of this invention to the manufacture of paper shows that polyelectrolyte/nanoparticle coating with positive or negative outermost layers is most efficient when approximately equal parts of positive and negative fibers are mixed during paper making. Such mixing results in at least 30% strength increase as compared with paper made from only negatively or only positively-nanocoated fibers. (See FIG. 13.)

The application of the method of this invention provides nanoparticle coating of fibers with different amount of layers on layers (e.g., 1, 2, 3, 4, 5, . . . and up to 30 or more) alternated with oppositely charged polymers. This technique allows controlled loading of fibers with nanoparticles in the range 0.1-5%. Then such nanoparticle-coated fibers are used for paper making in 50-50% mixtures oppositely-charged fibers. Nanoparticles useful in such coatings include silica, $Al_2O_3$, $SnO_2$, $TiO_2$ and different clays (plate-like and nanotubules). Coatings with nanotubules such as hallosites are especially suitable because they allow loading with biological and medical active molecules (such as special drugs) and their sustained release. Another embodiment includes the use of fiber nanocoating enzymes (proteins) which provide bio-catalytic properties to the fibers. In particular, laccase decomposes remaining lignin which results in improved whiteness in paper. The technique of the invention also applies positive nanocoating to modify broken recycled (mill broke, short-length) fibers to convert them to a glue-like material which in turn allows one to increase their proportion in the blend with (longer-length) virgin fibers to anywhere from 35% to 45%, and higher. This feature of the invention facilitates and increases the use of such recycled fibers in commercial operations. For example, 30% mill broke fiber nanocoated with $(PAH/PSS)_{3\text{-}3.5}$ in mixture with 70% virgin fibers gives the same paper strength as 10% mill broke fiber in mixture with 90% virgin fibers. Therefore, it is possible to triple the usage of nanocoated recycled broken fibers and thereby effect considerable cost savings in industrial scale operations.

While the present invention has been described in terms of particular embodiments and applications, in both summarized and detailed forms, it is not intended that these descriptions in any way limit its scope to any such embodiments and applications, and it will be understood that substitutions, changes and variations in the described embodiments, applications and details of the method illustrated herein and its operation can be made by those skilled in the art without departing from the spirit of this invention.

We claim:

1. A method for making paper with enhanced strength, comprising:

(a) forming a pulp of lignocellulose fibers;

(b) nanocoating said pulp of lignocellulose fibers by alternatively adsorbing onto the fibers multiple consecutively-applied layers of oppositely-charged nanoparticles and polymers, thereby making a modified pulp of multi-layer nanocoated lignocellulose fibers;

(c) draining the modified pulp to form one or more sheets of multi-layer nanocoated lignocellulose fibers;

(d) drying said formed one or more sheets of multi-layer nanocoated lignocellulose fibers; and (e) processing the dried nanocoated sheet or sheets to make a finished paper having enhanced strength and surface properties.

2. The method of claim 1, wherein said lignocellulose fibers used to form said pulp are broken recycled fibers.

3. The method of claim 1, wherein said oppositely-charged nanoparticles and polymers have a thickness of between about 5 and 100 nanometers.

4. The method of claim 1, wherein said oppositely-charged nanoparticles adsorbed onto the fibers are selected from the group consisting of silica, $TiO_2$, $Al_2O_3$ and $SnO_2$.

5. The method of claim 1, wherein said oppositely-charged nanoparticles adsorbed onto the fibers are selected from the group consisting of plate-like clays, such as kaolinates and montmorillonites, and tubule-like clays, such as hallosites.

6. The method of claim 1, wherein said pulp of lignocellulose fibers is an aqueous slurry having between about 0.5 and 15% solids.

7. The method of claim 1, wherein said nanocoating of said pulp of lignocellulose fibers is applied to broken recycled fibers to impart a positive charge and a glue-like consistency on said modified pulp of multi-layer nanocoated broken recycled fibers, and further comprising mixing said positively-charged modified pulp of broken recycled fibers with a pulp of virgin lignocellulose fibers.

8. The method of claim 1, wherein said draining of the modified pulp to form said sheets of multi-layer nanocoated lignocellulose fibers is carried out on one or more screens.

9. The method of claim 1, wherein oppositely-charged proteins, in addition to oppositely-charged nanoparticles and polymers, are used to nanocoat said pulp of lignocellulose fibers.

10. The method of claim 1, wherein oppositely-charged proteins, having a thickness of between about 5 and 100 nanometers and selected from the group consisting of laccase, glucose, oxidase, hemoglobin and myoglobin, are used, in addition to oppositely-charged nanoparticles and polymers, to nanocoat said pulp of lignocellulose fibers.

11. The method of claim 1, wherein said oppositely-charged polymers adsorbed onto the fibers are selected from the group consisting of branched poly(ethylenimine) (PEI), linear poly(dimethyldiallyl ammonium chloride) (PDDA), poly(allylamine hydrochloride) (PAH), chitosan, starch, linear sodium poly(styrenesulfonate) (PSS), poly(acrylic acid) (PAA), dextran sulfate, sodium alginate, gelatin B, carboxymethyl cellulose (CMC) and poly(3,4-ethylene-dioxythiophene)-poly(styrenesulfonate) (PEDOT-PSS).

12. The method of claim 1, wherein each said consecutively-applied layer of oppositely-charged nanoparticles and polymers has a thickness of between about 5 and 100 nanometers.

13. A method for making paper with enhanced strength, comprising:

(a) nanocoating a first aqueous pulp of lignocellulose fibers by alternatively adsorbing onto the fibers multiple consecutively-applied layers of oppositely-charged nanoparticles and polymers thereby making a first positively-charged modified aqueous pulp of multi-layer nanocoated lignocellulose fibers;

(b) nanocoating a second aqueous pulp of lignocellulose fibers by alternatively adsorbing onto the fibers multiple consecutively-applied layers of oppositely-charged nanoparticles and polymers thereby making a second negatively-charged modified aqueous pulp of multi-layer nanocoated lignocellulose fibers;

(c) blending said first positively-charged modified pulp of nanocoated fibers with said second negatively-charged modified pulp of nanocoated fibers to form a complex aggregate pulp of nanocoated fibers;

(d) draining the water out of the complex aggregate pulp to form one or more sheets of multi-layer nanocoated lignocellulose fibers;

(e) drying said formed one or more sheets of multi-layer nanocoated lignocellulose fibers; and (f) processing the dried nanocoated sheet or sheets to make a finished paper having enhanced strength and surface properties.

14. The method of claim 13, wherein said lignocellulose fibers used to form said aqueous slurry are broken recycled fibers.

15. The method of claim 13, wherein said oppositely-charged nanoparticles and polymers have a thickness of between about 5 and 100 nanometers.

16. The method of claim 13, wherein said oppositely-charged nanoparticles adsorbed onto the fibers are selected from the group consisting of silica, $TiO_2$, $Al_2O_3$ and $SnO_2$.

17. The method of claim 13, wherein said oppositely-charged nanoparticles adsorbed onto the fibers are selected from the group consisting of plate-like clays, such as kaolinates and montmorillonites, and tubule-like clays, such as hallosites.

18. The method of claim 13, wherein said first aqueous pulp of lignocellulose fibers and said second aqueous pulp of lignocellulose fibers are aqueous slurries having between about 0.5 and 15% solids.

19. The method of claim 13, wherein the volume of said first positively-charged modified aqueous pulp and the volume of said second negatively-charged modified aqueous pulp are substantially equal.

20. The method of claim 13, wherein said draining of the water out of the complex aggregate pulp to form said sheets of multi-layer nanocoated lignocellulose fibers is carried out on one or more screens.

21. The method of claim 13, wherein oppositely-charged proteins, in addition to oppositely-charged nanoparticles and polymers, are used to nanocoat said first aqueous pulp of lignocellulose fibers and said second aqueous pulp of lignocellulose fibers.

22. The method of claim 13, wherein oppositely-charged proteins, having a thickness of between about 5 and 100 nanometers and selected from the group consisting of laccase, glucose, oxidase, hemoglobin and myoglobin, are used, in addition to oppositely-charged nanoparticles and polymers, to nanocoat said first aqueous pulp of lignocellulose fibers and said second aqueous pulp of lignocellulose fibers.

23. The method of claim 13, wherein said oppositely-charged polymers adsorbed onto the fibers are selected from the group consisting of branched poly(ethylenimine) (PEI), linear poly(dimethyldiallyl ammonium chloride) (PDDA), poly(allylamine hydrochloride) (PAH), chitosan, starch, linear sodium poly(styrenesulfonate) (PSS), poly(acrylic acid) (PAA), dextran sulfate, sodium alginate, gelatin B, carboxymethyl cellulose (CMC) and poly(3,4-ethylene-dioxythiophene)-poly(styrenesulfonate) (PEDOT-PSS).

24. The method of claim 13, wherein said nanocoating of said first aqueous pulp of lignocellulose fibers is carried out consecutively through one adsorption step less than said nanocoating of said second aqueous pulp of lignocellulose fibers, and wherein the volume of positively-charged modified pulp and the volume of negatively-charged modified pulp in said blending step are substantially the same.

25. The method of claim 13, wherein said blending of the positively-charged modified pulp and the negatively-charged modified pulp creates an electrostatic cooperative complexation of multiple fibers bonding in forming said complex aggregate pulp of nanocoated fibers.

26. The method of claim 13, wherein said first positively-charged modified aqueous pulp of lignocellulose fibers is made from broken recycled fibers and said second negatively-charged modified aqueous pulp is made from virgin lignocellulose fibers.

27. The method of claim 13, wherein functional nanoparticles, such as $TiO_2$ and hallosites, are used to nanocoat said aqueous pulp of lignocellulose fibers so as to allow active molecules to be loaded on the resulting nanocoated fibers.

28. The method of claim 21, wherein the oppositely-charged proteins are enzymes, such as laccase, which are immobilized by the nanocoating process and act to decompose the lignocellulose fibers, thereby improving the whiteness of the resulting paper.

29. The method of claim 26, wherein the volume of said first portion of positively-charged modified pulp and the volume of said second portion of negatively-charged modified pulp fluctuate between about 30 and 70% of the total volume of pulp being treated.

30. The method of claim 13, wherein each said consecutively-applied layer of oppositely-charged nanoparticles and polymers has a thickness of between about 5 and 100 nanometers.

31. A process for manufacturing paper or paper board with enhanced strength and surface properties by means of self-assembly layer-by-layer nanocoating techniques in a plurality of sequential unit operations, said process comprising:

(a) nanocoating a first aqueous pulp of lignocellulose fibers having between about 0.5 and 15% solids by alternatively adsorbing onto the fibers multiple consecutively-applied layers of oppositely-charged polymers having a thickness of between about 5 and 100 nanometers, thereby making a first positively-charged modified aqueous pulp of multi-layer nanocoated lignocellulose fibers, said first positively-charged modified aqueous pulp comprising between about 30 and 70% of the total volume of pulp being processed;

(b) nanocoating a second aqueous pulp of lignocellulose fibers having between about 0.5 and 15% solids by alternatively adsorbing onto the fibers multiple consecutively-applied layers of oppositely-charged nanoparticles having a thickness of between about 5 and 100 nanometers, thereby making a second negatively-charged modified aqueous pulp of multi-layer nanocoated lignocellulose fibers, said second negatively-charged modified aqueous pulp comprising between about 30 and 70% of the total volume of pulp being processed;

(c) blending said first positively-charged modified pulp of nanocoated fibers with said second negatively-charged modified pulp of nanocoated fibers to form a complex aggregate pulp of nanocoated fibers;

(d) draining the water out of the complex aggregate pulp to form sheets of multi-layer nanocoated lignocellulose fibers;

(e) drying said formed sheets of multi-layer nanocoated lignocellulose fibers; and (f) processing the dried nanocoated sheets to make a finished paper having enhanced strength and surface properties.

32. The process of claim 31, wherein the nanocoating of said first aqueous pulp of lignocellulose fibers is controlled so that the ratio of oppositely-charged polymers to lignocellulose fibers contained in said positively-charged modified aqueous pulp is between about 0.1 and 5% by dry weight of polymers and dry weight of fibers, and the nanocoating of said second aqueous pulp of lignocellulose fibers is controlled so that the ratio of oppositely-charged nanoparticles to lignocellulose fibers contained in said negatively-charged modified aqueous pulp is between about 0.1 and 5% by dry weight of nanoparticles and dry weight of fibers.

33. The process of claim 31, wherein said first aqueous pulp of lignocellulose fibers comprises an aqueous slurry of broken (mill broke) recycled fibers.

* * * * *